US005519953A

United States Patent [19]

Villani

[11] Patent Number: 5,519,953

[45] Date of Patent: May 28, 1996

[54] EMPTY/MALFUNCTION ALARM FOR A FIREARM

[76] Inventor: Michael J. Villani, P.O. Box 2144, Centerville, Mass. 02632

[21] Appl. No.: 322,188

[22] Filed: Oct. 12, 1994

Related U.S. Application Data

[63] Continuation-in-part of Ser. No. 266,943, Jun. 27, 1994.

[51] Int. Cl.[6] ..... F41A 9/62

[52] U.S. Cl. ..... 42/1.02; 42/1.03

[58] Field of Search ..... 42/1.01, 1.02, 42/1.03, 1.04, 1.05, 70.02

[56] References Cited

U.S. PATENT DOCUMENTS

| | | | |
|---|---|---|---|
| 1,252,094 | 1/1918 | de Lempdes . | |
| 1,653,698 | 12/1927 | Coupland . | |
| 2,377,661 | 6/1945 | Baker et al. . | |
| 3,229,399 | 1/1966 | Harvey | 42/1.05 |
| 3,552,053 | 1/1971 | Jarvis | 42/1.03 |
| 4,001,961 | 1/1977 | Johnson et al. . | |
| 4,031,648 | 6/1977 | Thomas | 42/70.02 |
| 4,142,313 | 3/1979 | Musgrave . | |
| 4,216,601 | 8/1980 | Musgrave . | |
| 4,219,953 | 9/1980 | Musgrave . | |
| 4,494,329 | 1/1985 | Post et al. | 42/1.05 |
| 4,541,191 | 9/1985 | Morris et al. . | |
| 4,558,626 | 12/1985 | Bartolles . | |
| 4,587,756 | 5/1986 | Jakubaschik et al. | 42/50 |
| 4,793,085 | 12/1988 | Surawski et al. | 42/84 |
| 5,005,307 | 4/1991 | Horne et al. | 42/1.02 |
| 5,052,138 | 10/1991 | Crain | 42/1.02 |
| 5,142,805 | 9/1992 | Horne et al. | 42/1.02 |
| 5,303,495 | 4/1994 | Harthcock | 42/84 |

OTHER PUBLICATIONS

Advertisement, Tactell Ammo Indicators, Tactell Inc.
Advertisement, B–Square Competition Mounts.
Advertisement, Tasco Propoint, Tasco Sales Inc, 1993.
Advertisement, Law 2000, Aro–Tek, Ltd, 1993.

*Primary Examiner*—Charles T. Jordan
*Assistant Examiner*—Christopher K. Montgomery
*Attorney, Agent, or Firm*—Iandiorio & Teska

[57] ABSTRACT

An alarm system for distinguishing between an empty and a malfunction condition for a firearm having a breech block catch lever operated by the magazine follower to lock the breech block in the open position when the firearm is empty may include an indicator device and a switching system responsive to the catch lever being operated by the magazine follower to lock the breech block in the open position for setting the indicator device to a first state to represent that the magazine and chamber are empty and the breech block is locked open and not malfunctioning and responsive to the catch lever being unoperated and the breech block being free for setting the indicator device to a second state to represent that the firearm has stopped firing because of a malfunction.

93 Claims, 27 Drawing Sheets

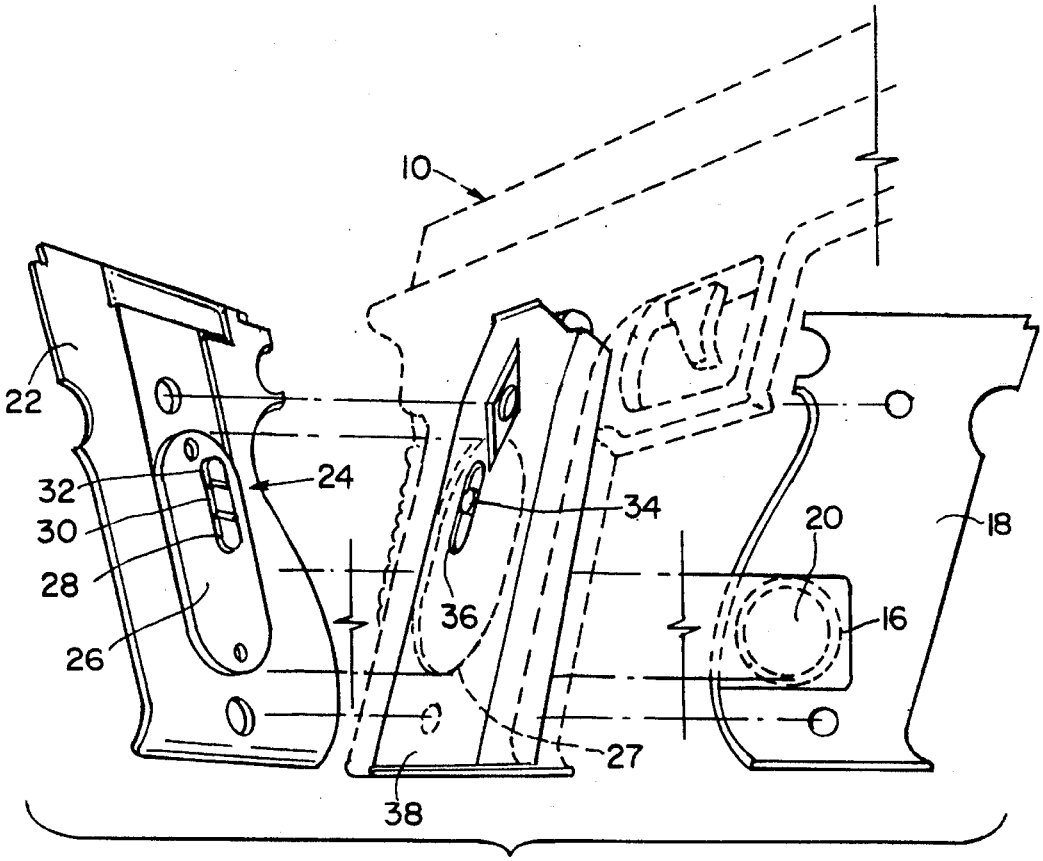
FIG. 6
FIG. 7
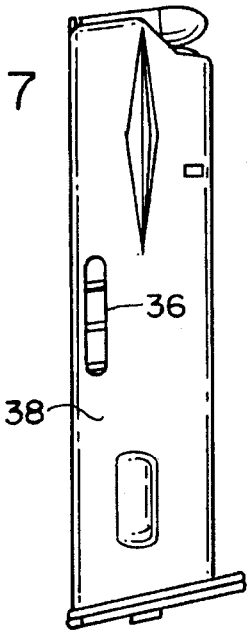
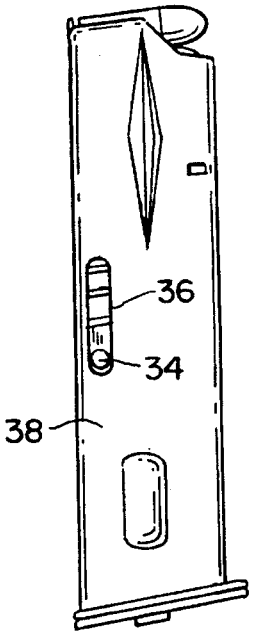
FIG. 8

EMPTY/MALFUNCTION ALARM FOR A FIREARM

RELATED CASE

This application is a continuation-in-part of U.S. patent application Ser. No. 08/266,943 filed Jun. 27, 1994, "Automatic Cartridge Monitoring and Indicator System for a Firearm", by Michael J. Villani.

FIELD OF INVENTION

This invention relates to an empty/malfunction alarm system for a firearm.

BACKGROUND OF INVENTION

When firing semi-automatic and automatic firearms in law enforcement, military actions and in target shooting competition it is desirable to know when the magazine is about to run out of ammunition. Competition shooters need to know this information so they can be prepared to release the empty magazine and replace it with a full one with minimum loss of shooting time. In police and military operations the need to know is far more serious. Police officers and soldiers can lose their lives in the split second it takes to realize a magazine must be replaced, or an enemy or felon can escape in that time. And studies have shown that under the stress of a firefight it is nearly impossible for the user to keep accurate track of the cartridges fired and those remaining. Prior attempts to monitor the number of cartridges in a magazine by indicating the number expended or the number remaining have met with indifferent success, and by and large applied generally only to pistols and not other firearms. The apparatus often was large and cumbersome and required modifications to each firearm for retrofitting or required redesign for installation with original equipment manufacturers. Such systems did not distinguish between an empty condition and a jammed condition. There were often on-off switches: a real drawback when the user forgets to turn on the system. The prior art designs often relied solely on displaying a count of the number of cartridges spent or remaining, which meant that the shooter had constantly to be watching the display: there was no alarm that communicated urgency. And the brightness of the display was fixed and not adaptable to ambient light conditions or shooters with poorer eyesight. Often the display used an LCD which is not visible in dark or low light conditions, a serious problem in many law enforcement situations. Typically there was no way to test the battery or other power supply or the display to see that the monitoring system was working. The known systems also impeded the free-fall of a released magazine and were not waterproof, a serious shortcoming in police and military applications. And the addition of the monitoring system to the firearm often interfered seriously with the critical ergonomics of the firearm.

There are additional problems. Even systems that do an adequate job of keeping track of the number of cartridges remaining or expended do not clearly and compellingly distinguish between the condition when the firearm will no longer fire because there are no more cartridges in the magazine and chamber, and the condition when the firearm will no longer fire because there is a malfunction or jam. The misunderstanding of this situation can result in a loss of time and concentration in competition and can cost a law enforcement officer or soldier his life. When a firearm stops firing the user must first check to see if it simply out of ammunition: if it is not he must go through a malfunction clearance drill which requires him to pull back and release the breech and tap the magazine which further delays the resumption of firing. There is a further problem in that in the haste of competition or a life-threatening firefight the user often forgets to release the breech after insertion of a fresh magazine which again wastes precious time and can confuse or panic the user. The difficulty in distinguishing between an empty condition and a malfunction and in insuring that the breech is released upon insertion of a fresh magazine is exacerbated by the fact that in most situations, especially law enforcement actions, over eighty percent of firefights occur in low-level light conditions where observation of an empty or a malfunction condition or the breech block position is extremely difficult.

SUMMARY OF INVENTION

It is therefore an object of this invention to provide an empty/malfunction alarm system which distinguishes between a truly empty magazine and chamber condition and a malfunction condition.

It is a further object of this invention to provide such an empty/malfunction alarm system which is small and compact.

It is a further object of this invention to provide such an empty/malfunction alarm system which clearly and compellingly indicates the condition as empty or malfunction and reminds that the breech must be released to commence firing after a fresh magazine has been inserted.

It is a further object of this invention to provide such an empty/malfunction alarm system which is easily retrofitted to existing firearms or incorporated in new firearms.

It is a further object of this invention to provide such an empty/malfunction alarm system which preserves the critical ergonomics of the firearm.

It is a further object of this invention to provide such an empty/malfunction alarm system which is combinable with a cartridge monitoring and indicator system.

It is a further object of this invention to provide such an empty/malfunction alarm system which enables the indicator portion of the system to be located on the firearm at a remote location.

The invention results from the realization that a truly accurate and reliable firearm alarm system which dependably distinguishes between a truly empty condition and a malfunction or jam condition can be achieved by sensing the position of the catch lever and clearly and compellingly indicating one state when the firearm has stopped firing because there are no more cartridges and another state when the firearm has stopped firing because of a malfunction, and the further realization that the same system that indicates an empty/malfunction condition can also function to clearly and compellingly indicate the need to release the breech to commence firing when a fresh magazine has been inserted.

This invention features an alarm system for distinguishing between an empty and a malfunction condition for a firearm having a breech block catch lever operated by the magazine follower to lock the breech block in the open position when the firearm is empty. There is an indicator device and a switching system, responsive to the catch lever being operated by the magazine follower to lock the breech block in the open position, for setting the indicator device to a first state to represent that the magazine and chamber are empty and the breech block is locked open and not malfunctioning and responsive to the catch lever being unoperated and the breech block being free for setting the indicator device to a second state to represent that the firearm has stopped firing because of a malfunction.

In a preferred embodiment the switching system may include a first switching circuit responsive to the catch lever being operated or unoperated by the magazine follower for setting the indicator device selectively to the first and second states. The switching system may include a second switching circuit including an actuator movable with the follower and a monitoring device disposed along the path of the follower and operable by said actuator to monitor the level of the follower and the level of cartridges in the magazine and set the indicator device to represent the level of cartridges in the magazine. The first switching circuit may include a switch element and an operator for operating the switch element. The operator may be on the catch lever, integral with the catch lever, securable to the catch lever or independent of but operated by the catch lever. The operator may be pivotably mounted on the firearm and may be spring biased against operation by the catch lever. The operator may be disposed on the opposite side of the firearm from the catch lever and may be fixedly interconnected with the catch lever by a pivot pin for rotation as a unit.

The catch lever may include a first section operated by the magazine follower to lock the breech block in the open position and a second, separate section operated by the magazine follower to operate the first switching circuit. The first switching circuit may include a switching device. The switching device may include at least one switch. The switching device may be mounted on the firearm. The indicator device may provide a representation of a malfunction. The representation provided by the indicator device may include a visual display. The visual display may include at least one light. The visual display may include an alphanumeric readout. The firearm may include two handle grips and at least one of the grips may include a housing for holding at least a portion of the first switching circuit.

The first switching circuit may have a power source and the power source may be in the housing. The power source may include a battery. The indicator device may be mounted on the firearm. The firearm may include handle grips and the indicator device may be fixed to one of the grips. The first switching circuit may be always energized and operate automatically. The first switching circuit may include a test switch for energizing the indicator device to demonstrate its operability. The first switching circuit may include an adjustment device for setting the brightness of the at least one light. The adjustment device may sense ambient light levels and set the brightness of the at least one light as a function of the ambient light. The at least one light may include an LED.

The at least one switch may include a membrane switch. The firearm may have handle grips and the membrane switch may be mounted in an internal recess in one of the grips. The firearm may include handle grips, the switching system may include a power source in one of the grips and the first switching circuit in the other of the grips and the power source and the first switching circuit may be electronically interconnected by a first flat ribbon conductor disposed within the existing grips. The power source may be housed within a second flat ribbon conductor interconnected with the first flat ribbon conductor. The indicator device may be contained in a mounting box and the one of the grips may include a recess for receiving the mounting box. The mounting box may be sized for an interference fit with the recess. The battery may be mounted internally on a handle grip and extend into an aperture existing on the firearm frame. The firearm may include handle grips, the switching system may include a power source in one of the grips and the first switching circuit in the other of the grips and the power source and first switching circuit may be electrically interconnected by conductors in each of the grips and connection pins in one grip that engage sockets in the other grip.

There may be a remote data connector responsive to the switching system for providing a representation to a remote device of the condition of the firearm. The firearm may be a pistol, a rifle, or a shotgun. The monitoring device may include a switching device. The switching device may include at least one switch or a plurality of switches. The switching device may be mounted on the firearm. The indicator device may provide a representation of the number of cartridges remaining in the magazine or may provide a representation of the total number of cartridges remaining in the magazine and chamber of the firearm. The indicator device may provide a representation that the last cartridge is in the chamber and the magazine is empty.

The magazine follower may include a follower element and a spring device for urging the follower element to feed the cartridges to the firearm. The magazine follower may include a follower element, an intermediate element spaced from the follower element, a first spring device between the elements and a second spring device engaged with the side of the intermediate element opposite the first spring device. The first spring device opens before the second spring device and remains open while the second spring device opens. The magazine follower may include a limiter device interconnecting the elements to define the distance by which the elements can be separated by the first spring device. The magazine follower mechanism may include an actuator mounted for movement with the intermediate element. The magazine follower mechanism may include an actuator mounted for movement with the follower element. The second spring device may include two spring sections, an upper and a lower section, the upper section being smaller in diameter than the lower section. The magazine follower may include an actuator mounted for movement with the follower element and a single spring device for urging the follower element to feed cartridges into the firearm.

The firearm may include two handle grips and at least one of the grips may include a housing for holding at least a portion of the monitoring device. The monitoring device may include a power source and the power source may be in the housing. The power source may include a battery. The light may be energized when there is but one cartridge remaining in the chamber of the firearm. The visual display may include two lights, the first of which is energized when there is one cartridge left in the chamber of the firearm and the second of which is energized where there is one cartridge in the chamber and one cartridge left in the magazine. The first light may be red and the second light may be yellow. The visual display may include three lights, the first of which is energized when there is one cartridge left in the chamber of the firearm, the second of which is energized where there is one cartridge in the chamber and one cartridge left in the magazine, and the third of which is energized when there is one cartridge in the chamber and two cartridges left in the magazine. The first light may be red, the second light may be yellow, and the third light may be green. The first light may remain energized after the last cartridge has been fired.

The visual display may include at least two lights, one of which is energized when there is one cartridge left in the chamber and none in the magazine; that light and at least one other of the lights may be energized when the magazine and chamber are empty and the breech block is locked open.

The visual display may include three lights, with six different combinations, the first light is energized when there may be one cartridge left in the chamber of the firearm, the second light is energized when there is one cartridge in the chamber and one cartridge in the magazine, the third light is energized when there is one cartridge in the chamber and two cartridges in the magazine, the first, second and third lights may be energized when the magazine is empty, the chamber is empty of cartridges, and the breech bolt is locked open by the catch lever; the first light is deenergized when the empty magazine is ejected leaving the second and the third lights energized with a breech bolt locked open by the catch lever, and the first, second, and third lights are not energized when the magazine is full and the breech bolt is free from the catch lever or the magazine is not in the firearm and the breech bolt is free from the catch lever.

The monitoring device may be always enabled and operate automatically upon the level of cartridges reaching a predetermined level. The monitoring device may include a test switch for energizing the indicator device to demonstrate its operability. The monitoring device may include an adjustment device for setting the brightness of the at least one light. The adjustment device may sense ambient light levels and may set the brightness of the at least one light as a function of the ambient light. The at least one light may include an LED. The second switching circuit may include at least one switch element and one operator element and an actuator for operating the switch element. The switch element may include a membrane switch. The switching device may include a membrane switch and the firearm may include an aperture for permitting the actuator to engage the membrane switch. The firearm may have handle grips and the membrane switch may be mounted in an internal recess in one of the grips. The operator element may be mounted on the inside of a grip and extend through an aperture in the handle of the firearm.

The firearm may include handle grips, the monitoring device may include a power source in one of the grips and the second switching circuit in the other of the grips and the power source and the second switching circuit may be electronically interconnected by a first flat ribbon conductor disposed within the existing grips. The power source may be housed within a second flat ribbon conductor interconnected with the first flat ribbon conductor.

The second switching circuit may include at least one switch element responsive to the actuator. The switch element may include a membrane switch. The actuator may be spring loaded and the firearm may include handle grips and one of the handle grips may include a recess for accommodating extension of the actuator protruding from the magazine for permitting the magazine to move freely in the firearm and a camming surface at the end of the recess for gradually compressing the actuator to facilitate removal of the magazine when ejected from the firearm. The actuator may have an actuator element extending from each side of the magazine. The monitoring device may include a switching device which may include at least one switch element associated with each side of the magazine for operation by an associated one of the actuator elements. The actuator elements may be spring loaded and the firearm may include two handle grips; each of the handle grips may include a recess for accommodating extension of the associated the actuator element protruding from the magazine for permitting the magazine to move freely, centrally, longitudinally in the firearm and a camming surface at the end of each recess for gradually compressing the actuator elements to facilitate removal of the magazine from the firearm. The second switching circuit may include at least one switch element, each switch element may include a pair of spaced conductors and the actuator may include a conductive contact for bridging the spaced conductors and electrically connecting them to actuate the indicator device. The battery may be mounted internally on a handle grip and extend into an aperture existing on the firearm frame. The firearm may include handle grips, the monitoring device may include a power source in one of the grips and the switching device in the other of the grips and the power source and a switching device may be electrically interconnected by conductors in each of the grips and connection pins in one grip that engage sockets in the other grip.

The actuator may include a spring loaded actuator element and the actuator element may include a cam surface to guide it back into the magazine to facilitate easy loading of cartridges into the magazine. The magazine follower may include a follower element and an intermediate element spaced from the follower element, a first spring device between the elements and a second spring device engaged with the side of the follower element facing the intermediate element. The firearm may include a magazine release mechanism, the switching device may be biased to enter an aperture in the magazine to engage the actuator, and the switching device may include an interconnection device responsive to the release mechanism for overcoming the bias and retracting the switching device from the magazine aperture simultaneously with the operation of the release to enable the magazine to freely fall from the firearm. The magazine and switching device may be in the frame of the firearm. The magazine may be mounted in a magazine receiver and the switching device may be mounted on the outside of the receiver through an aperture. The magazine follower mechanism may include two interconnected sections movable relative to each other, the actuator may include at least one actuator element on at least one of the sections and biasing means for urging apart the sections and urging the actuator element to engage the switching device.

DISCLOSURE OF PREFERRED EMBODIMENT

Other objects, features and advantages will occur to those skilled in the art from the following description of a preferred embodiment and the accompanying drawings, in which:

FIG. 6 is a view of the firearm of FIG. 1 shown in phantom with the handle grips exploded out, revealing the battery compartment, second switching device and actuator in the magazine;

FIG. 7 is a side elevational view of a magazine adapted in accordance with this invention usable in the firearm of FIG. 1 before the actuator becomes visible;

FIG. 8 is a view similar to FIG. 7 after the actuator has become visible;

FIG. 18 is a view similar to FIG. 16 where the slide is back, and the red light remains on;

Figure 1:
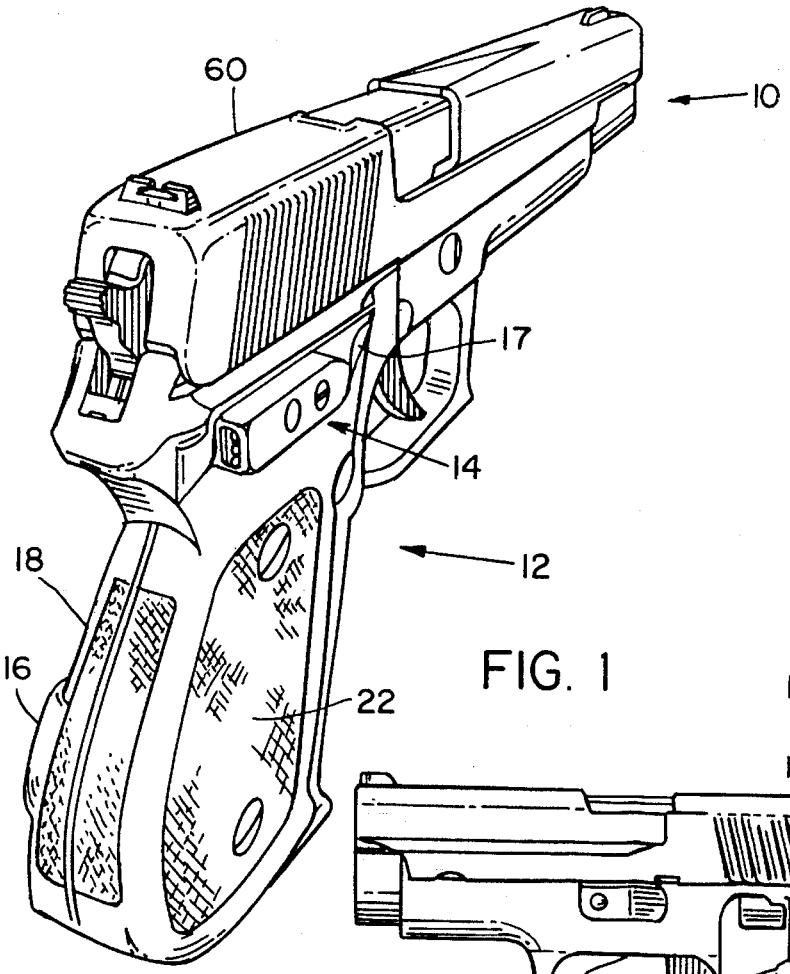
FIG. 1 is a perspective view of a semi-automatic pistol utilizing an automatic cartridge monitoring and indicator system.

This invention may be accomplished with a switching system that responds to the breech block catch lever being operated by the magazine follower to lock the breech block in the open position to set an indicator device to a first state representing that the firearm has stopped firing, the magazine and chamber are empty, the breech block is locked open by the catch lever, and the firearm is not malfunctioning and responds to the firearm having stopped firing and the breech block not being locked open by the catch lever to set the indicator device to a second state representing a possible malfunction.

The switching system could have two switching circuits. A first switching circuit responds to the catch lever being operated by the magazine follower to lock the breech block in the open position and sets the indicator device to the first state indicating an empty and functioning firearm or a second state indicating a malfunction. A second switching circuit includes an actuator movable with the magazine follower and a monitoring device disposed along the path of the follower and operable by the actuator to monitor the level of the follower and thus the level of cartridges in the magazine.

In the embodiments illustrated here the switching system uses lights to indicate the cartridge level and uses a subset of those lights to distinguish empty from malfunction. For example, the second switching circuit monitoring the number of cartridges in the firearm may light a green light when there are three cartridges left, two in the magazine and one in the chamber; a yellow light when there are two cartridges remaining, one in the magazine and one in the chamber; and a red light when there are no cartridges in the magazine and one in the chamber. The red light will stay on until the empty magazine is ejected: when it is ejected the red light will be de-energized. The first switching circuit responsive to the catch lever operated by the follower lights the yellow and green lights when the catch lever has been operated by the follower of the empty magazine and the breech is locked open, giving a clear and compelling indication that the firearm is empty but functioning properly.

In operation then, if the firearm stops firing and the yellow and green lights are lit, that indicates that the catch lever is up and the breech block is locked open with the red light lit. It also means that the magazine is empty since the catch lever can only be up when the follower is at the top of its travel in an empty magazine. That the magazine is empty is also confirmed by the fact that the second switching circuit has sensed an empty magazine and lit the red light. The red light will stay on until the empty magazine is ejected: when it is ejected the red light will be de-energized. With all three lights lit green, yellow, and red the indication is that the firearm is in a first state: out of ammunition with the breech locked open, and is not malfunctioning.

If on the other hand the firearm stops firing and no lights are lit or only one light, the green, the yellow, or the red, is lit, the indication is that the firearm is in a second state: it is jammed or malfunctioning. This is so because if no lights or only the green alone or yellow alone lights are lit that means there is still ammunition left. If the red light is lit but the yellow and green together are not that means the magazine is out of ammunition but the catch lever is not up and the breech is not locked open: there is a malfunction.

This invention can also display a third state in which the user is reminded by the indicator (which is activated when the breech block is locked in the open position by the catch lever) to release the breech by operating the catch lever to chamber a cartridge, thereby deactivating the indicator. When used in conjunction or combined with the second monitoring switch circuit, the third state is displayed upon the empty magazine being ejected which deenergizes the red light, leaving the green and yellow lights lit by the first circuit. Thus the third state is now displayed. Upon inserting a new, full magazine into the firearm the user immediately knows or is reminded to operate the catch-lever releasing the breech to chamber a cartridge, thereby deenergizing the green and yellow lights. When the first switch circuit is used alone without the second monitoring circuit, the third state is displayed when the switch is actuated by the breech block being locked back. When the user releases the breech block the switch is deactivated.

The invention thereby provides clear and compelling indications of the firearm's condition which are reliable and unambiguous and which immediately attract the attention of the user even under the stress of a firefight and even in low light conditions. The term breech block is a generic term as used herein, encompassing all manner of automatic self loading weapon mechanisms, e.g., the slide mechanism on a pistol, the bolt on a rifle.

Figure 68:
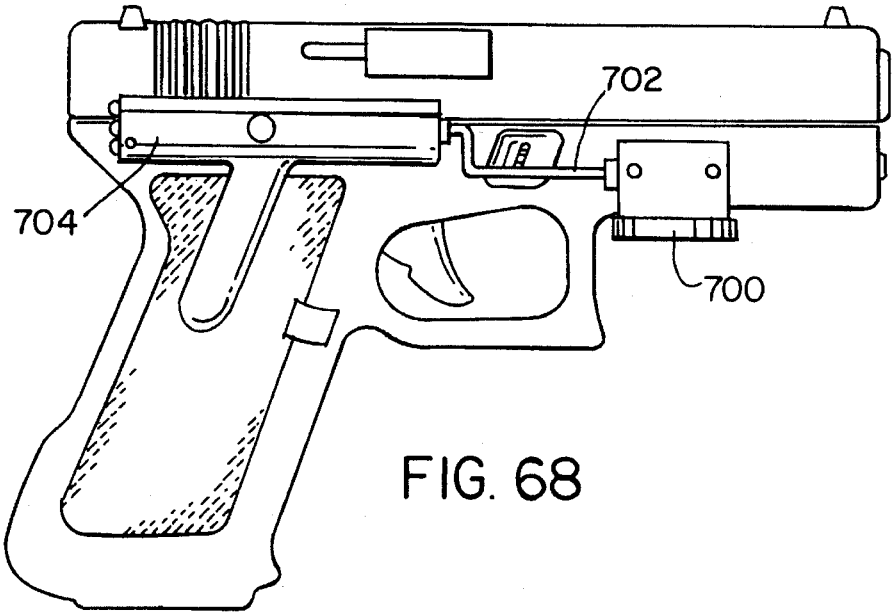
FIG. 68 is a side sectional elevational view of a firearm specially modified to accept the monitoring and indicator system.
Figure 78:
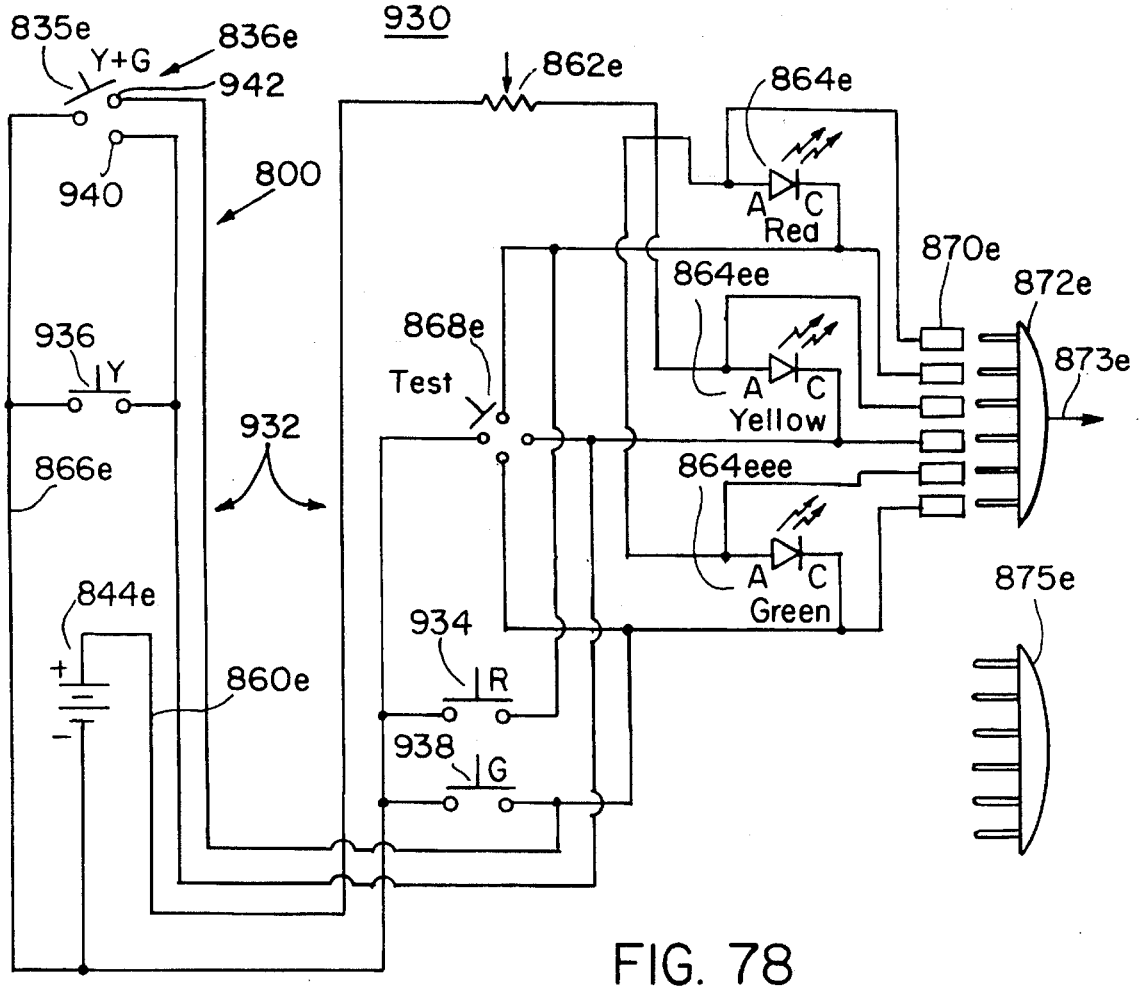
FIG. 78 is a simplified schematic diagram of a combined empty/malfunction alarm and cartridge monitoring and indicator.
Figure 72:
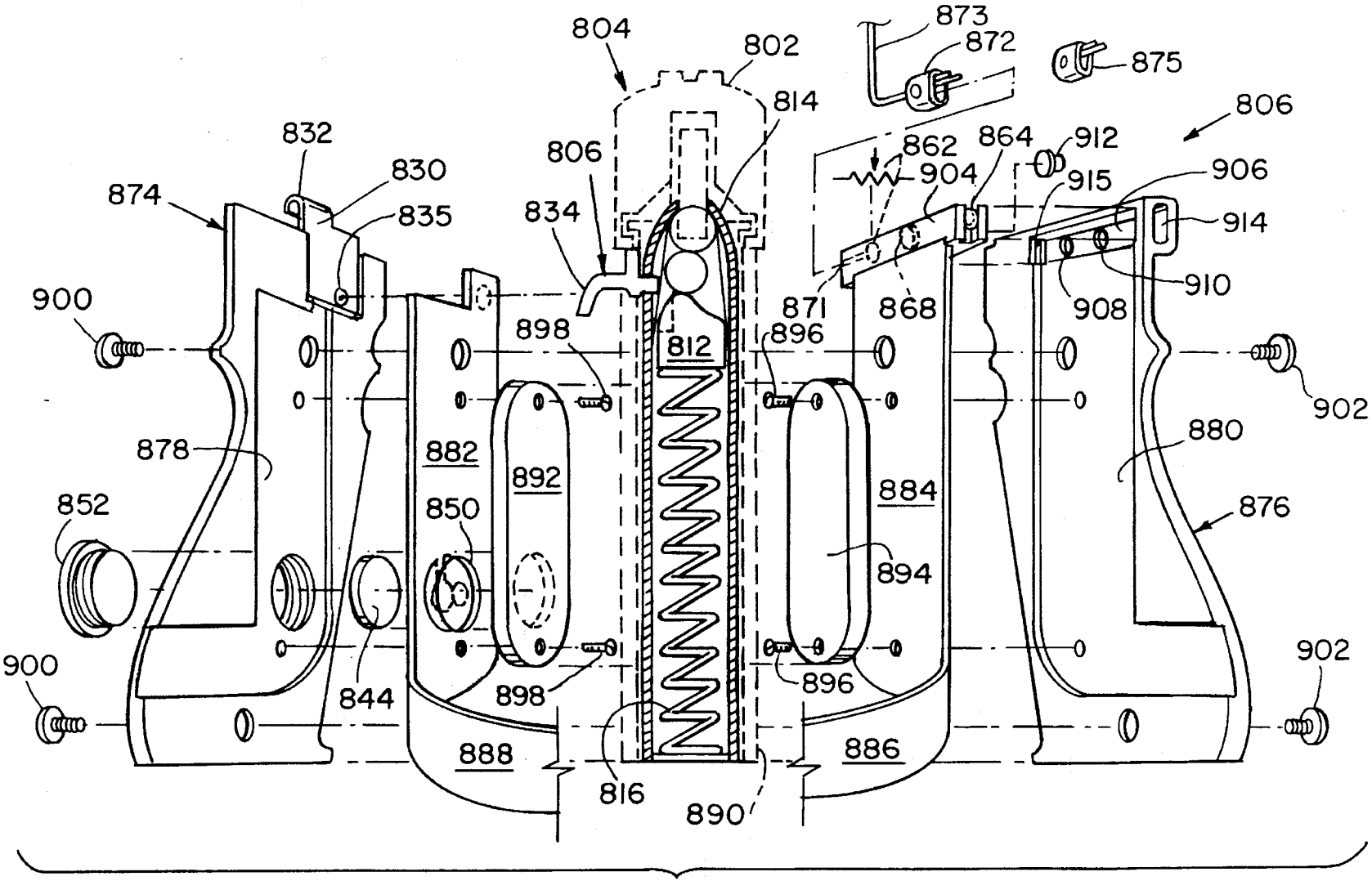
FIG. 72 is an exploded view of the handle of the firearm of FIGS. 69 and 70 viewed from the rear showing the disposition of the components of the circuit of FIG. 71.
Figure 79:
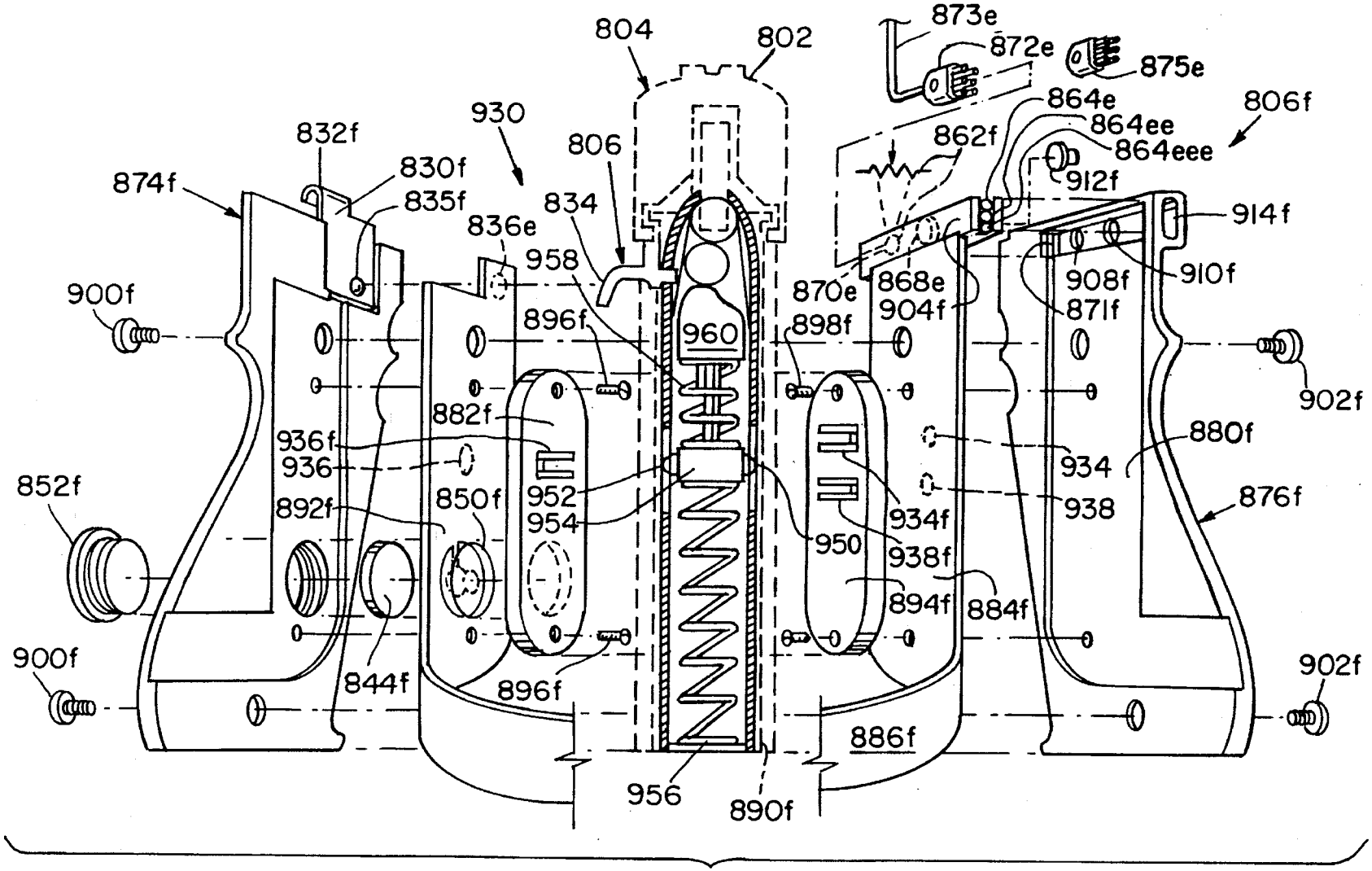
FIG. 79 is a view similar to FIG. 72 showing the disposition of the components of the circuit of FIG. 78.

In the description of the drawings that follows, FIGS. 1–68 are generally directed to the second switching circuit that monitors the level of cartridges in the magazine and chamber, FIGS. 69–72 are directed to the first switching circuit that monitors the condition of the breech block catch lever, FIGS. 73–77 show various catch lever-switch operator constructions for the first switching circuit, and FIGS. 78–79 are directed to a firearm that utilizes the first and second switching circuits. Throughout the specification and drawings like elements have been given like numbers and similar elements like numbers accompanied by a lower case letter or a prime.

Figure 2:
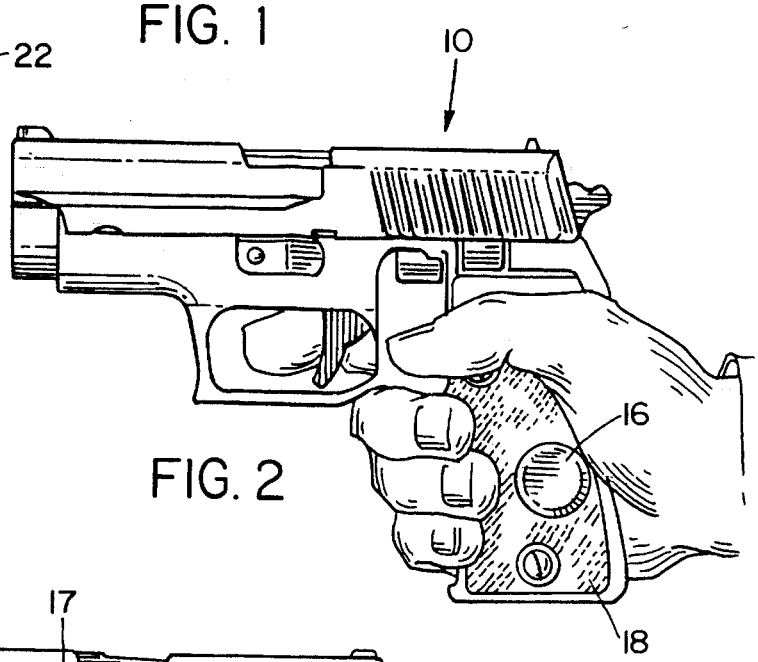
FIG. 2 is a left side view of the firearm of FIG. 1 illustrating the position of the battery compartment.
Figure 3:
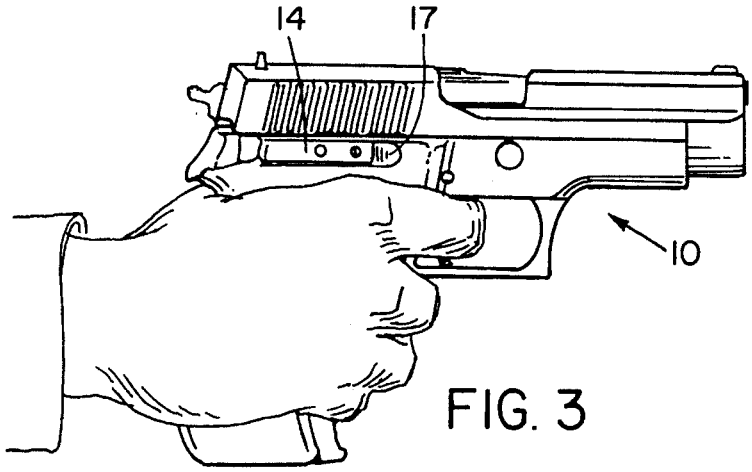
FIG. 3 is right side view of the firearm of FIG. 1 illustrating the position of the indicator device.
Figure 4:
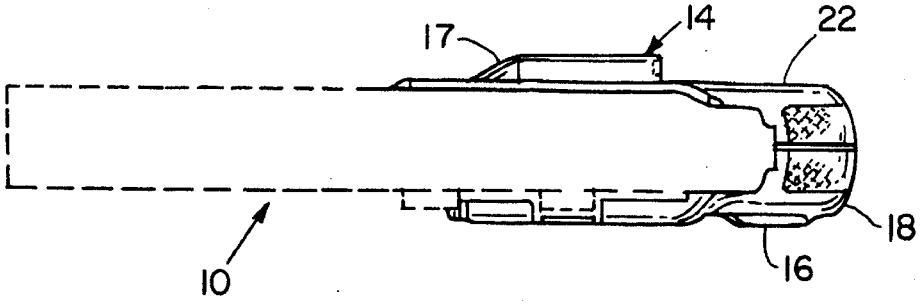
FIG. 4 is a top plan view of a portion of the firearm of FIG. 1 showing both the indicator device and battery compartment.
Figure 5:
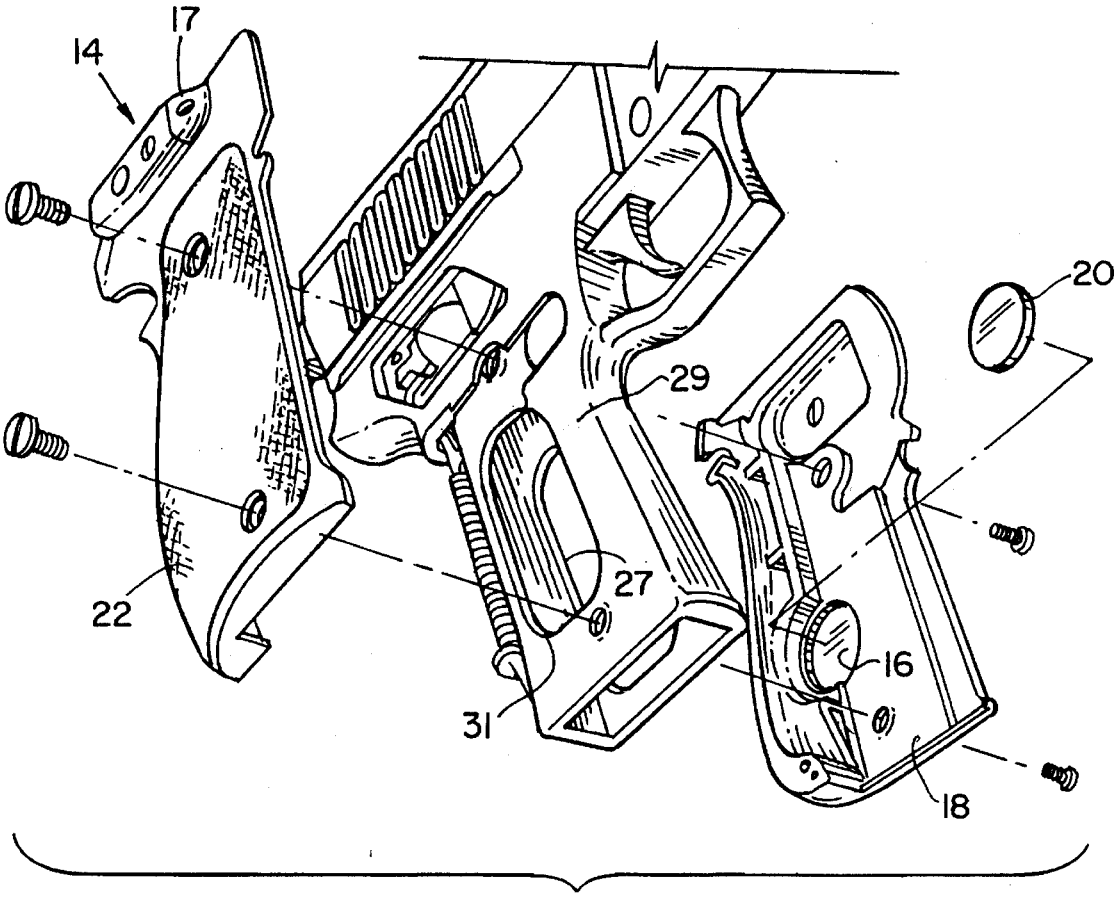
FIG. 5 is a view of the firearm of FIG. 1 with the handle grips exploded out showing the battery compartment.

There is shown in FIG. 1 firearm 10 including the monitoring and indicator device 12 including indicator device 14 and battery housing 16 on left handle grip 18. Dummy plug 17 engages and seals (waterproofs) the remote data connector. The small, compact nature of system 12 and its ergonomic elegance can be seen in FIGS. 2 and 3, where the protruding battery housing 16, FIG. 2, and indicator device 14, FIG. 3, are small, unobtrusive, and do not interfere with the hand of the user. The limited bulk of battery housing 16 and indicator device 14 are shown even more dramatically in FIG. 4. Battery 20, FIG. 5, fits inside of battery housing 16 in left handle grip 18. Right handle grip 22, which carries indicator device 14, has its internal portion revealed in FIG. 6, where a switching device 24 can be seen including plate 26 and three switching elements 28, 30 and 32 that are engaged by actuator 34 slidable in slot 36 in magazine 38. Plate 26 is received in aperture 27, FIG. 5, of frame handle or receiver frame 29 and is flush with the interior magazine chamber wall 31. Actuator 34 does not appear in slot 36, FIG. 7, until there are only a predetermined number of cartridges spent or, conversely, there are a predetermined number of cartridges remaining. When that point occurs, actuator 34, FIG. 8, appears at the low end of slot 36.

Figure 9:
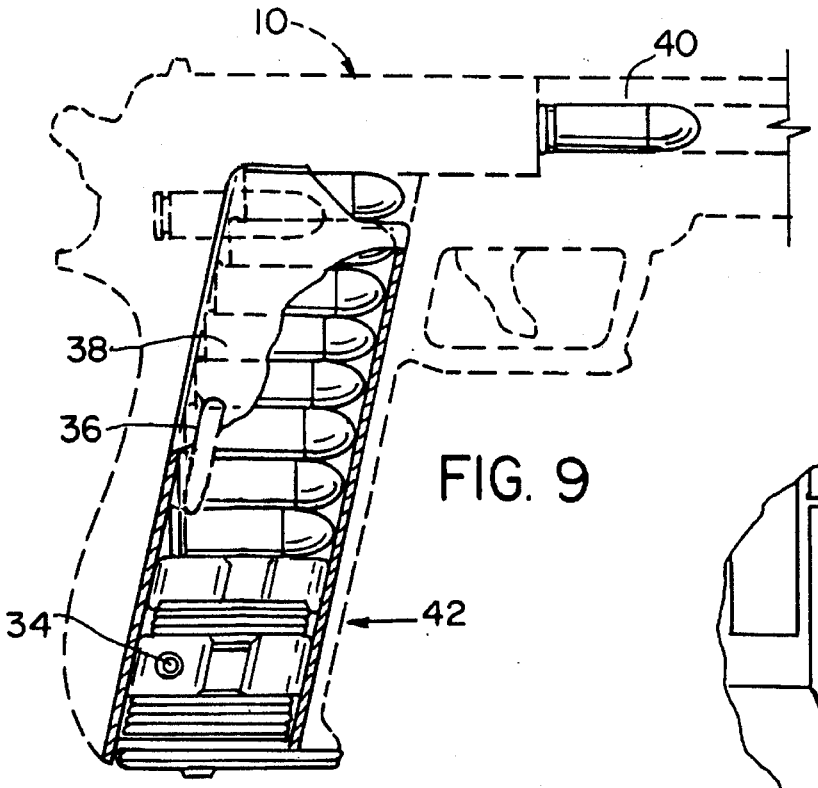
FIG. 9 is a side elevational view, with the firearm shown in phantom, of a loaded magazine with a fully compressed follower mechanism.
Figure 11:
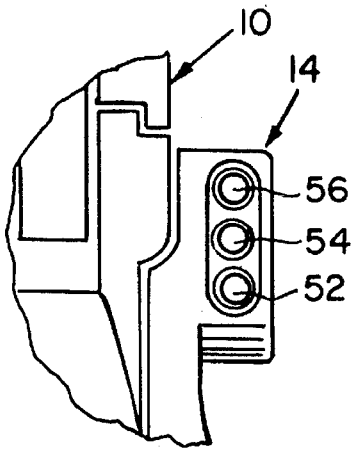
FIG. 11 is an enlarged view of the display device in the black condition where none of the indicator alarm lights are energized.
Figure 10:
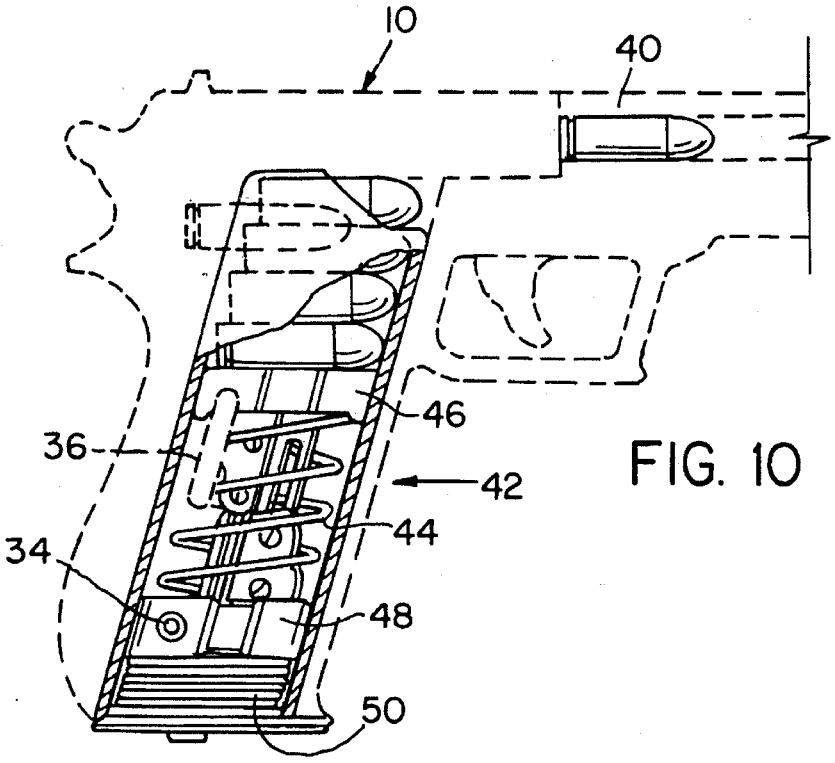
FIG. 10 is a view similar to FIG. 9 with the magazine with five cartridges remaining and the follower mechanism extended.

When firearm 10 is fully loaded, FIG. 9, with, for example, fifteen cartridges in doublestack magazine 38 and one in the chamber 40, follower mechanism 42 is fully compressed. As firing commences and cartridges are expended, the upper, stronger spring 44, FIG. 10, separates follower element 46 from follower intermediate element 48 while the lower, weaker spring 50 remains compressed. Since the upper spring 44 is stronger it fully extends before spring 50 begins to extend, thereby firmly and early setting the distance from follower element 46 to intermediate element 48, enabling accurate measuring of the cartridge level. At this point the three display lights 52, 54 and 56, FIG. 11, which may for example be different colors such as green, yellow and red, respectively, are dark, and this is known as the black condition. The red light stays on even after the last cartridge is fired, indicating an empty condition. If the firearm fails to fire and the red light is not energized that indicates a jam or other malfunction. In this particular embodiment three lights are used, but one or any number may be used, and also in this embodiment three lights are used to indicate three, two and one cartridges left, but this too is not a necessary limitation. In addition, although throughout this specification the indicator device is shown as a visual display, this is not a necessary limitation as other types of signalling, such as sound, infrared for night vision security, or other means could be used. And various types of visual displays may be used, e.g., symbols, lights, alphanumeric characters.

Figure 12:
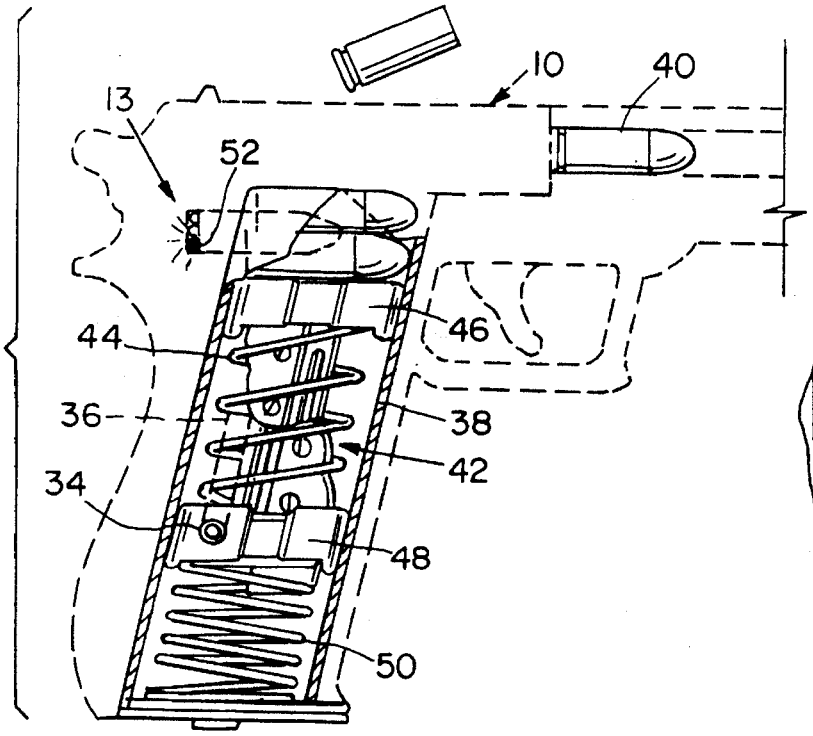
FIG. 12 is a view similar to FIG. 10 in which the second spring of the follower mechanism is extended, there are three cartridges remaining, one in the chamber of the firearm and two in the magazine and the first of three lights, a green one, is lighted.
Figure 13:
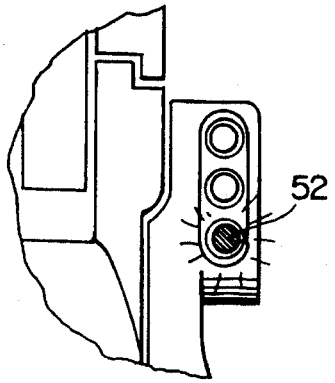
FIG. 13 is an enlarged end view showing the lighted green light.
Figure 15:
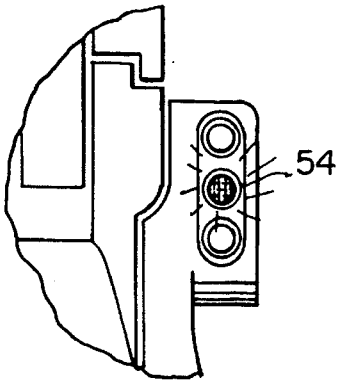
FIG. 15 is a view similar to FIG. 13 showing the lighted second, yellow, light.
Figure 14:
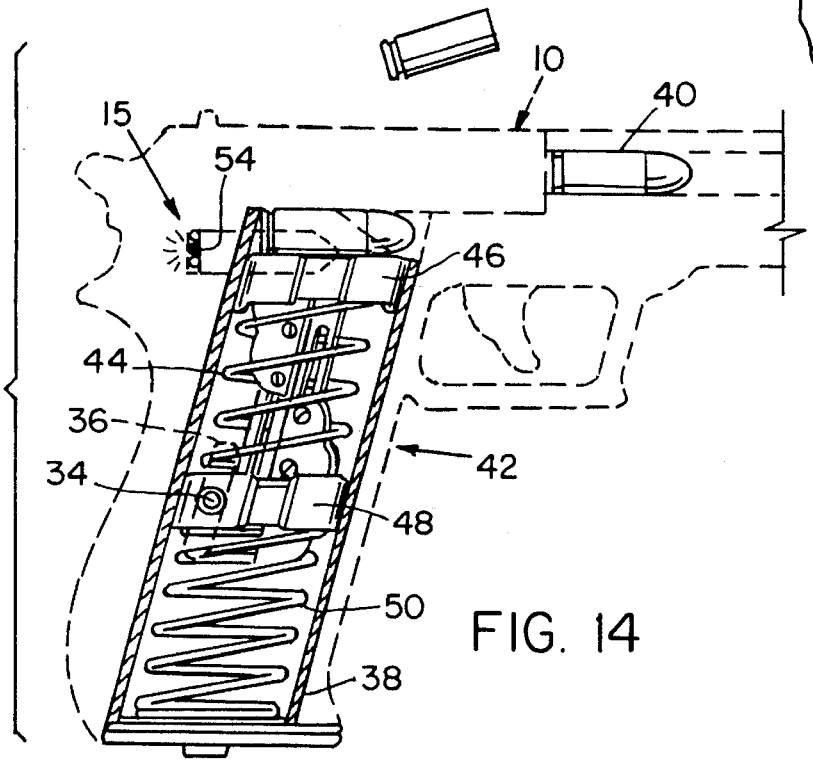
FIG. 14 is a view similar to FIG. 12 with one cartridge in the firearm and one in the magazine, with the second, yellow light, lighted.
Figure 16:
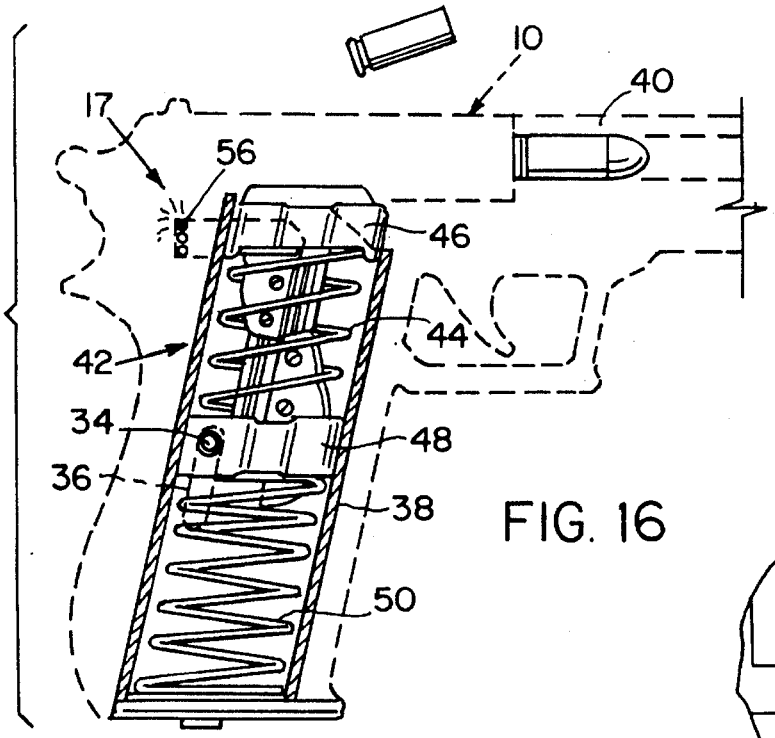
FIG. 16 is a view similar to FIGS. 12 and 14 with both springs of the follower mechanism extended, only one cartridge left in the firearm chamber, and the third, red, light lighted.
Figure 17:
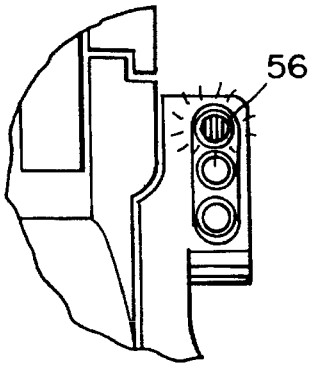
FIG. 17 is a view similar to FIG. 15 showing the third, red, light lighted.
Figure 18:
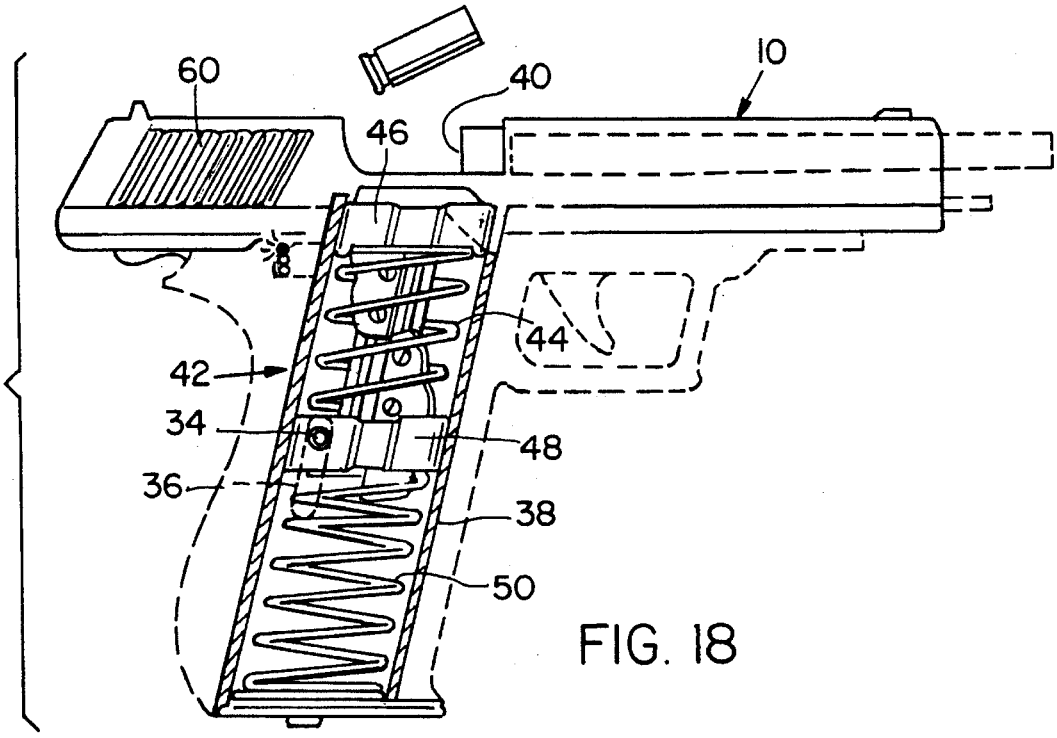

As firing progresses from this point, there will eventually occur the situation where there is one cartridge in chamber 40 of firearm 10 and two in magazine 38, FIG. 12. At this point in this embodiment lower spring 50 has begun to uncoil and actuator 34 has engaged the first switch 28, FIG. 6, so that the green light 52, FIG. 13, comes on indicating that there are three cartridges left, two in the magazine and one in the chamber. As lower spring 50 uncoils it pushes follower element 42 upwards to continue feeding cartridges. Follower element 42 stays completely open while under pressure from lower spring 50 throughout feed of cartridges from magazine 38. When that round is fired and there is but one left in the chamber and one in the magazine, FIG. 14, the second, yellow, light 54, FIG. 15, is energized. Following this, when there is but one cartridge left in chamber 40, FIG. 16, the third and last, red, light 56, FIG. 17, is energized. After this, even though there are no more cartridges to be fired, the red light stays on as long as an empty magazine is in place, and with the slide 60 locked back to indicate an empty firearm, as in FIG. 18. When the shooter releases the empty magazine 38, FIG. 18, from the firearm, the switch opens and deenergizes the red light. The system will then reset itself when a fresh magazine with an adequate supply of ammunition is inserted into the firearm.

Figure 19:
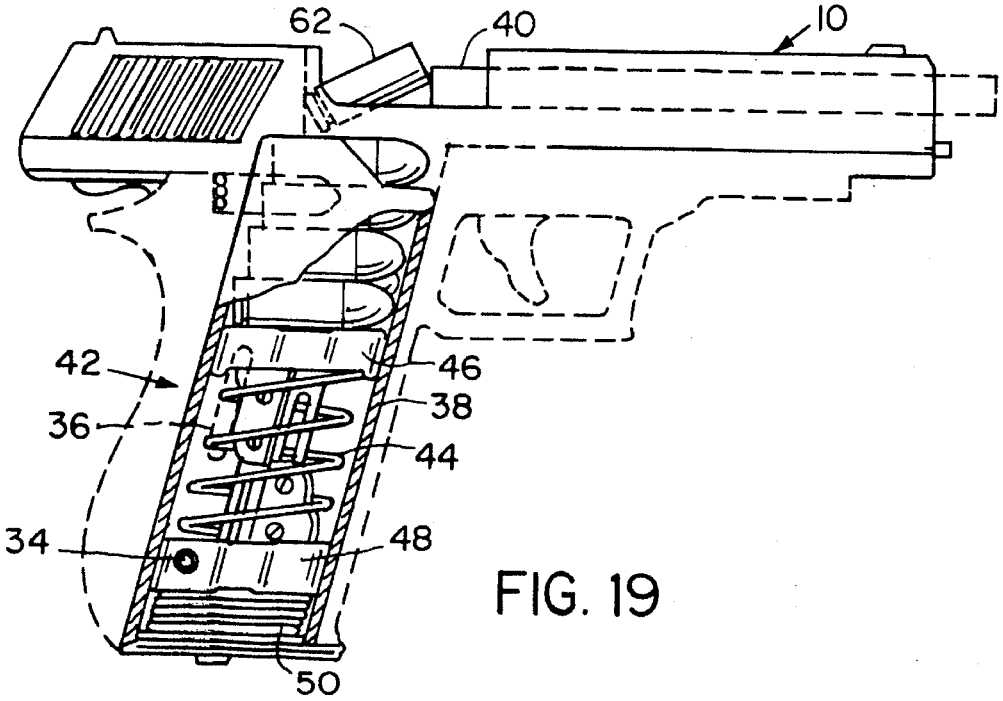
FIG. 19 is a view similar to FIG. 10 in which a cartridge has become caught in the mechanism so that the gun will not fire and the indicator is in the black condition with no lights lighted, indicating a jammed condition.

If using the second switching circuit described alone without the first switching circuit there is the added advantage of indicating when the firearm is not functioning because of a malfunction and not because of a lack of ammunition. For example, when a spent cartridge casing 62, FIG. 19, is jammed in chamber 40, and there is ample ammunition in magazine 38, no red light energized 56, FIG. 17, since the actuator is not at a level where it can engage the last switch 32, FIG. 6.

Although in the example of this embodiment the indicator device, that is the lights, are energized to represent the various conditions, this is not a necessary limitation of the invention: the lights or other indicator device could be normally energized and be deenergized to represent the various states of the firearm.

Figure 20:
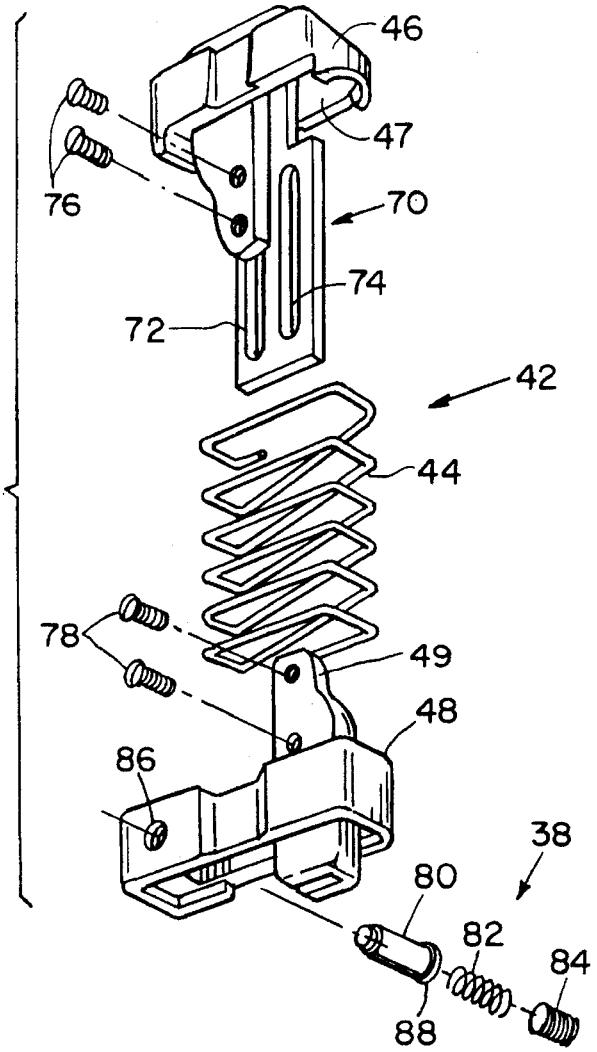
FIG. 20 is an exploded three-dimensional view of a two-part follower mechanism with actuator according to this invention.
Figure 22:
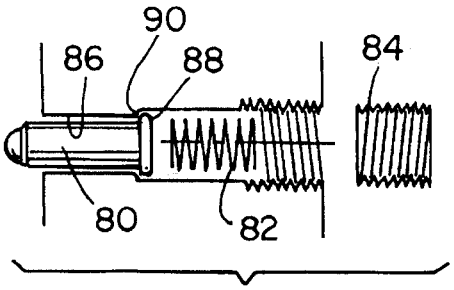
FIG. 22 is a side sectional elevational view of a portion of the intermediate element of the follower mechanism of FIG. 20 showing the installation of the actuator.
Figure 21:
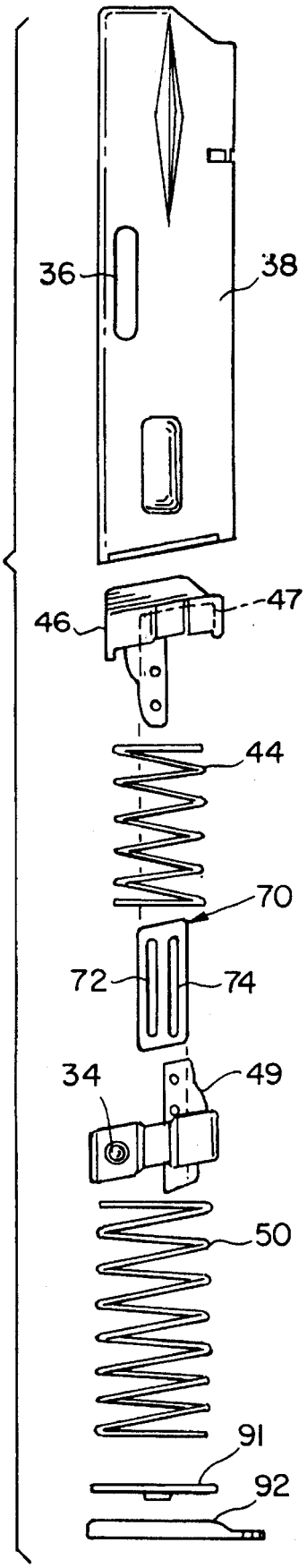
FIG. 21 is an exploded three-dimensional side view of the two-part follower mechanism of FIG. 20 with the magazine and springs.

Follower mechanism 42 is shown in greater detail in FIG. 20 along with single-ended actuator, where it can be seen that follower element 46 is interconnected with intermediate element 48 by means of limiter 70 which includes two slots 72 and 74, that enable elements 46 and 48 to move toward and away from each other to the limit allowed by limiter 70. Cavity 47, FIG. 20, inside follower element 46 accepts the top of post 49, FIG. 20, and the top of limiter 70 when follower element 42 is compressed. Screws 76 and nuts (not shown) mount limiter 70 through slot 72 to follower element 46 while screws 78 and nuts (not shown) mount limiter 70 through slot 74 to intermediate element 48. In this way spring 44 is enabled to urge apart elements 46 and 48 only to the limit allowed by limiter 70. Actuator 38 includes a single actuator element 80 urged outward by spring 82 mounted against threaded base 84, all of which fit in bore 86 in intermediate element 48, as can be seen more clearly in FIG. 22, wherein the rear flange 88 of actuator element 80 acts to retain it in bore 86 against shoulder 90. Lower, weaker spring 50 nests in the bottom of intermediate element 48 and rests on lock plate 91, FIG. 21, on the floor plate 92 of magazine 38.

Figure 23:
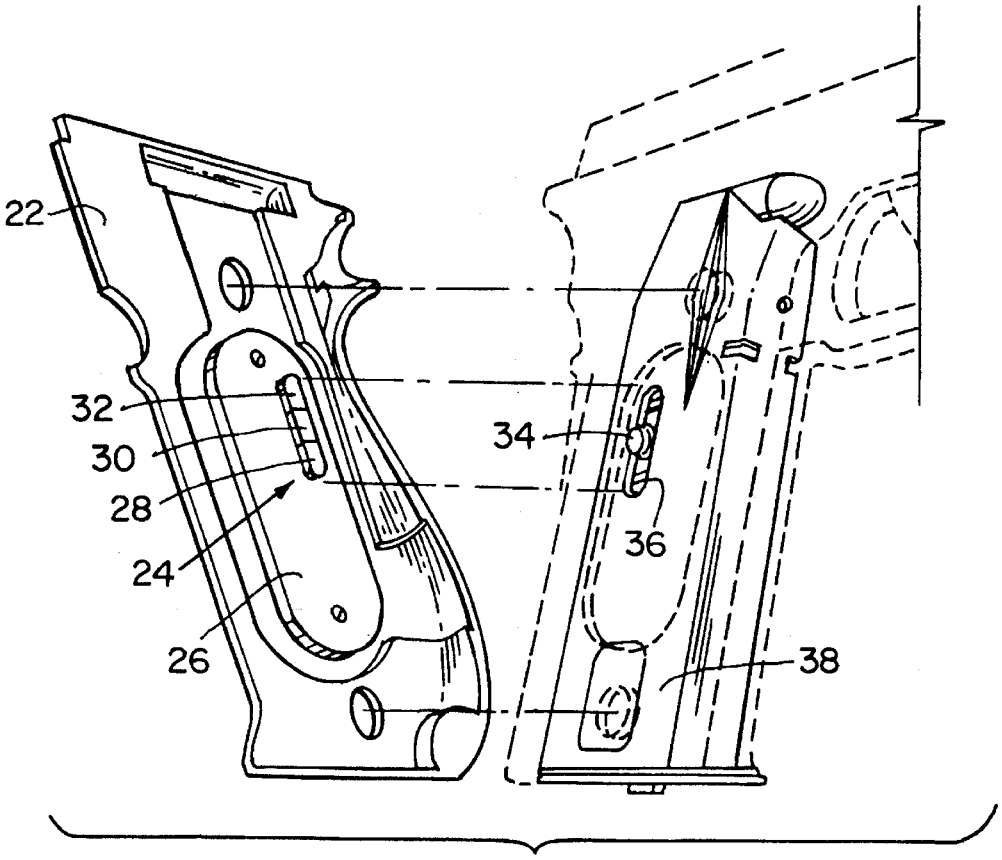
FIG. 23 is an exploded three-dimensional view showing the second switching device mounted in the handle grip and the actuator protruding from an aperture in the magazine.
Figure 25:
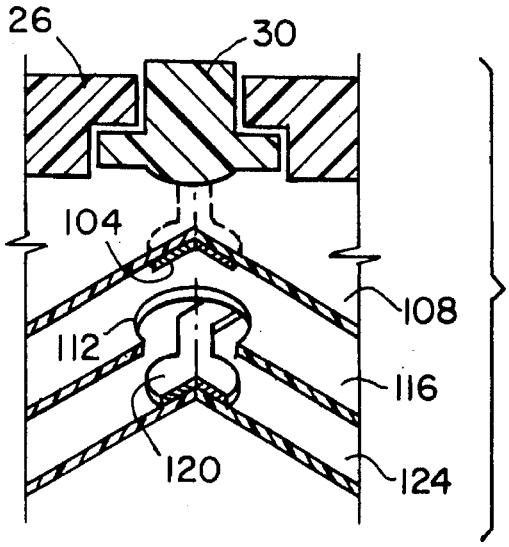
FIG. 25 is an enlarged detailed view of one operator and its associated membrane switch.
Figure 24:
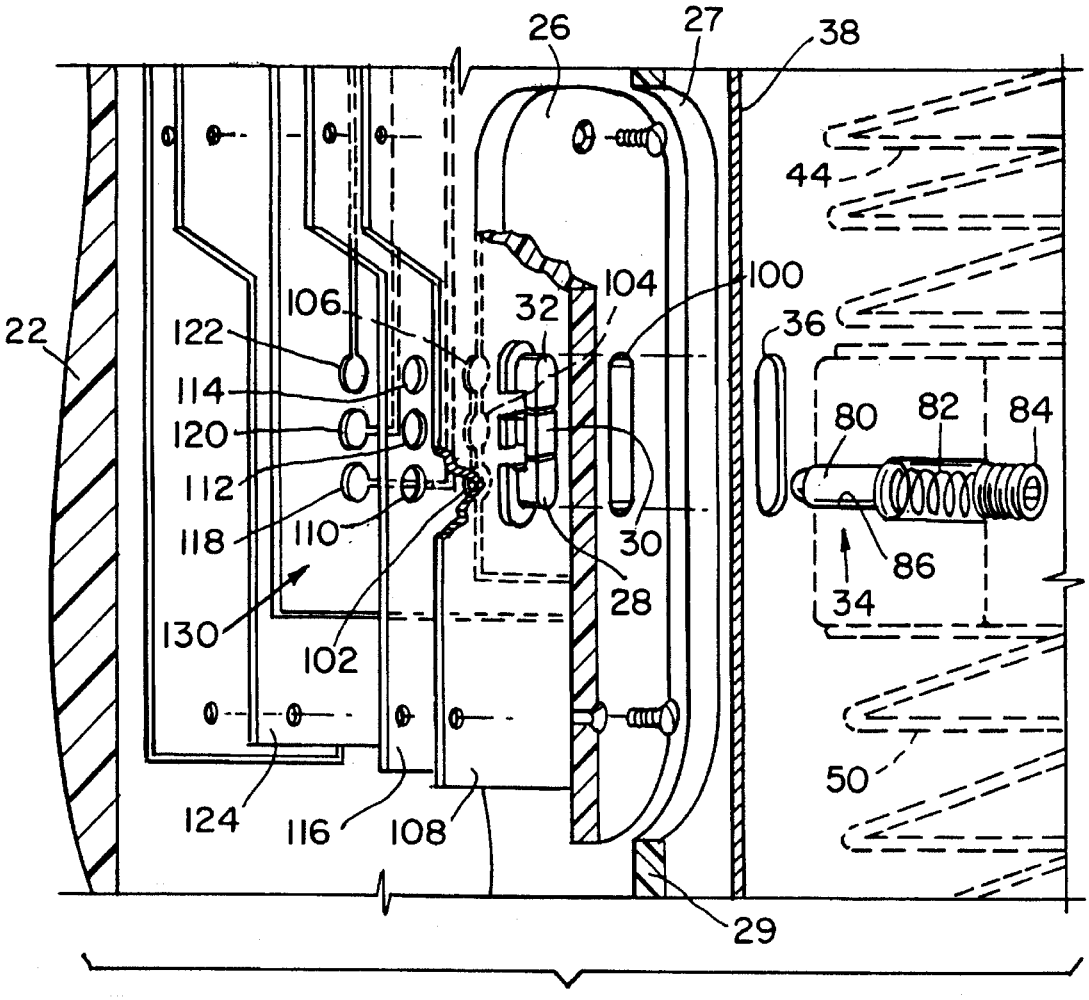
FIG. 24 is an enlarged exploded view of the second switching device and actuator with portions broken away.

Actuator 34, FIG. 23, protrudes from slot 36 in magazine 38 to engage switching device 24 which includes the three operator members 28, 30 and 32 mounted on grip 22 by plate 26. The three operator elements 28, 30 and 32 extend through slot 100, FIG. 24, which aligns with slot 36 in magazine 38. The pressure of actuator 34 on each one of operators 28, 30 and 32 causes them to engage, respectively, contacts 102, 104 and 106, FIG. 24, on sheet 108 through holes 110, 112 and 114 in sheet 116 to engage contacts 118, 120 and 122 on sheet 124 which constitute a membrane. These are known as membrane switches, one of which is shown in greater detail in FIG. 25, where portions have been cut away for clarity. The membrane construction may also be used to house the battery, but one integral membrane can house the battery electrically interconnected with the switching device, and also house the switching device itself as shown with respect to FIGS. 24 and 25.

Figure 26:
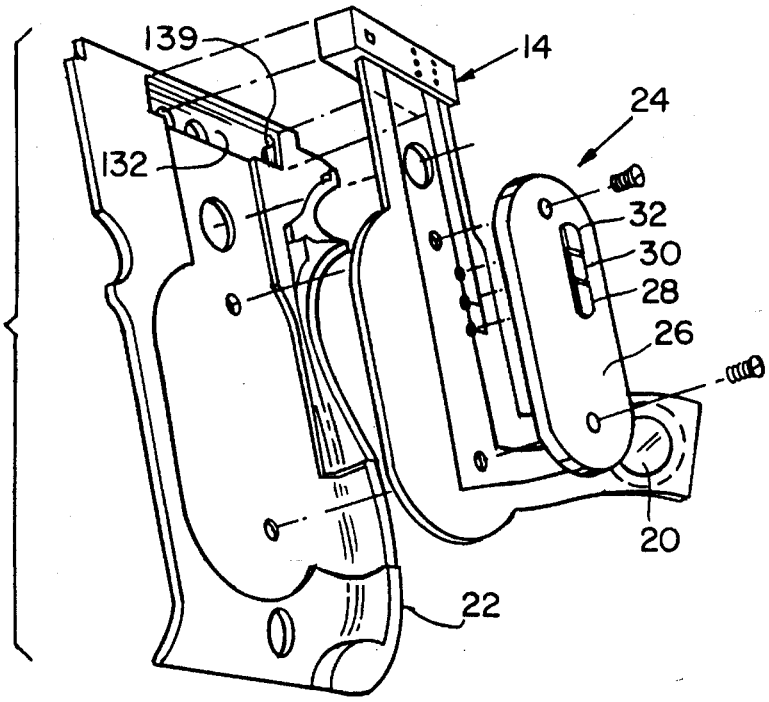
FIG. 26 is an exploded view showing a handle grip with the second switching device and the indicator device.
Figure 27:
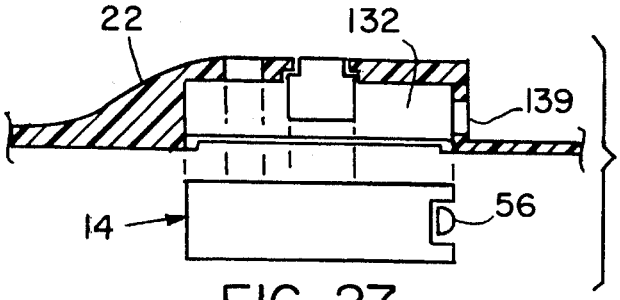
FIG. 27 is a top plan view showing the fit of the indicator device in the handle grip.
Figure 28:
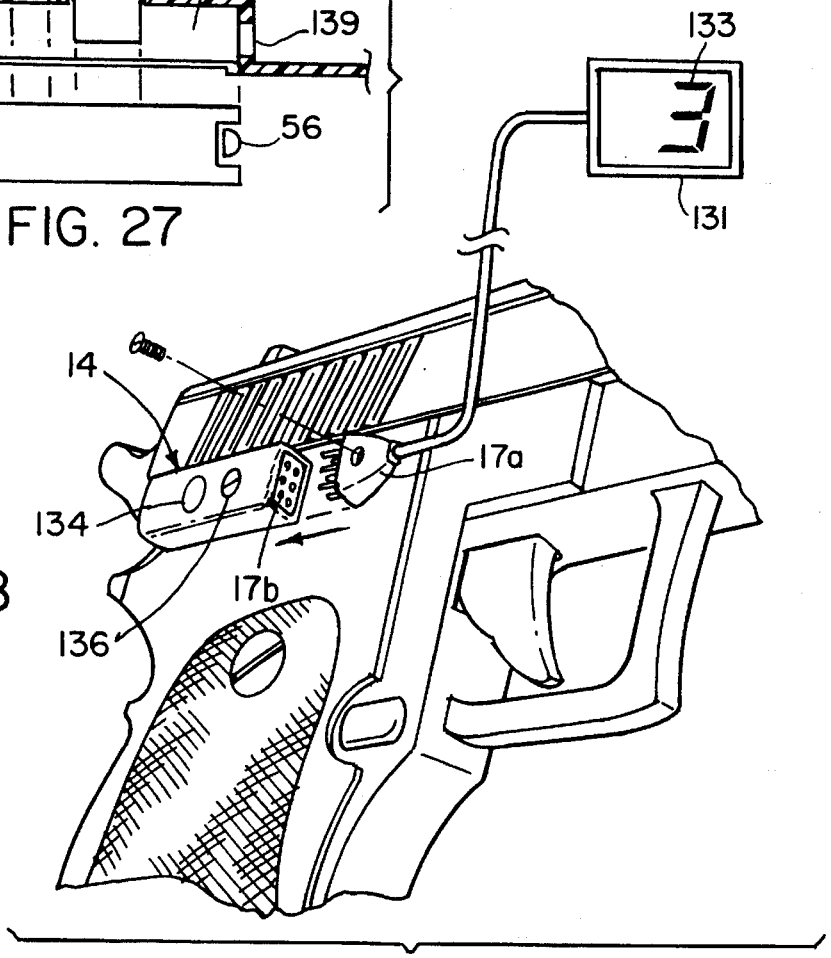
FIG. 28 is an enlarged three-dimensional view of the indicator device, the test button, brightness adjustment, and remote data connector.

The entire monitoring and indicator system is installable on most firearms without any alterations or modifications to the firearm itself. Other firearms may require some alteration. All of the required circuitry and components may be mounted on a pair of handle grips which can replace the original equipment handle grips. The membrane 130, FIG. 24, which employs sheets 108, 116 and 124 and the attendant elements, may now be extended to hold battery 20 and may also be used to interconnect them with indicator device 14, FIG. 26. The indicator device fits snugly into recess 132 in handle grip 22, as can be seen more clearly in FIG. 27 and light 56 when energized can be seen through slot 139 in handle 22, FIGS. 26, 27. A test button 134, FIG. 28, and brightness adjustment device 136, FIG. 28, are mounted on the side of indicator device 14. The brightness adjustment 136 may be either a small potentiometer or variable resistor or it may be a photoresistor which is sensitive to ambient light conditions so that the brightness is automatically controlled. In FIG. 28 sealing plug 17, FIG. 1, has been removed and remote data connector **17*a* has been inserted in its place in receptacle 17*b* to deliver data to another remote device which may be a display device or an electronic circuit or digital processor 131 for further collecting, analyzing and/or recording or displaying the information such as in alphanumeric form 133**.

Figure 29:
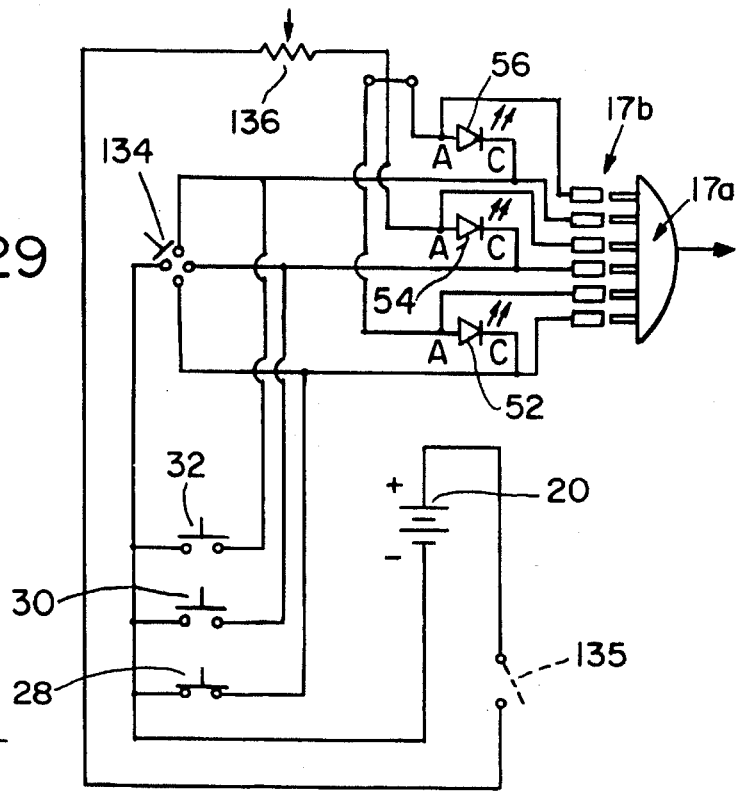
FIG. 29 is an electrical schematic diagram of the monitoring switching device alarm lights, battery, brightness adjustment, test button, and remote data connector.
Figure 30:
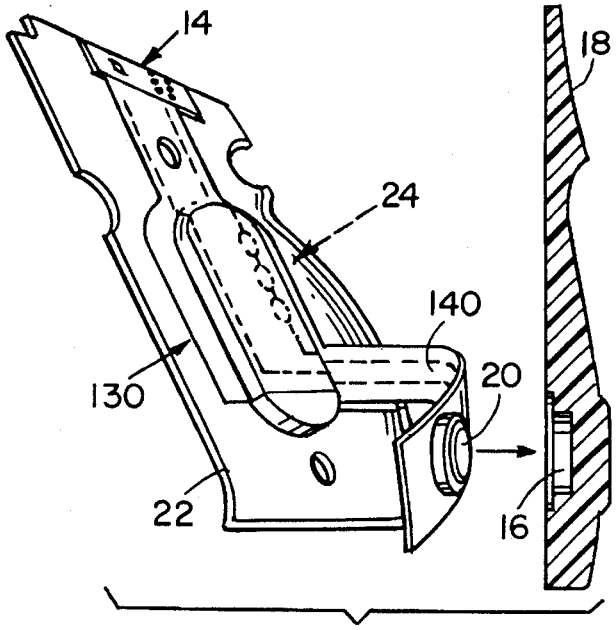
FIG. 30 is a three-dimensional view of the handles with portions in section showing the membrane interconnecting the indicator device and switching device on one handle grip and wrapping around the handle to connect with the battery in the other handle grip.

Test button 134, FIG. 29, connects battery 20 to each of the lights 52, 54 and 56 such as implemented by LEDs so that the battery and the lights can both be checked. A conventional on-off switch 135 can be employed if desired. Photoresistor or variable resistor 136 directly controls the current flow to each of the LEDs to set the brightness. Switch 28 is shown closed while switch elements 30 and 32 are shown open. The use of the single continuous membrane 130 to interconnect indicator device 14, switching device 24 and battery 20 is shown to advantage in FIG. 30, where battery housing 16 and handle grip 18 readily receive battery 20 in membrane 130. While the remaining portion of the membrane 140 wraps around between handle grips 18 and 22 and extends beyond switching device 24 to indicator device 14. Since there is no on-off switch the system is on whenever actuator 34 engages any of switches 28, 30, 32.

Figure 31:
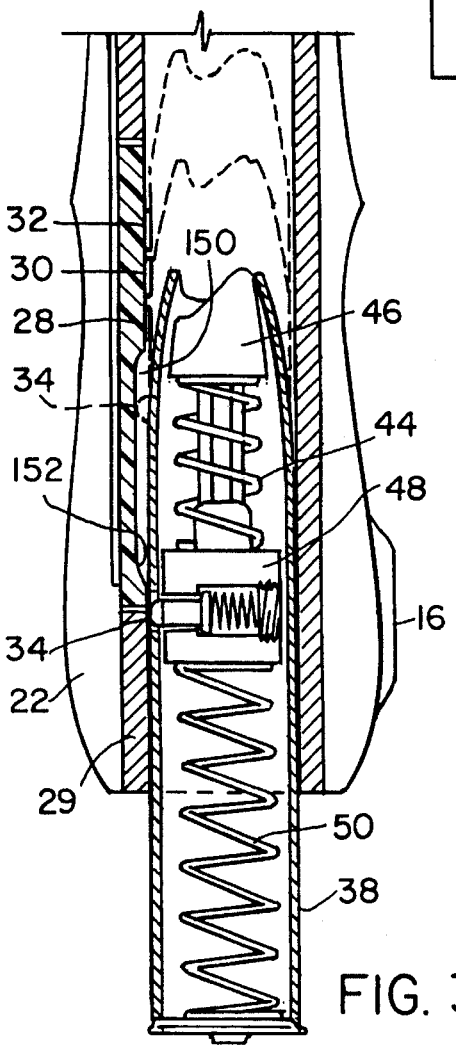
FIG. 31 is a sectional view of the handle of the firearm showing a camming recess for facilitating free-fall release of the magazine.

In order to facilitate free-fall easy release of magazine 38, FIG. 31, a camming recess 150, FIG. 31, may be provided on the inside of handle grip 22 so that when the magazine is released and begins to drop out, actuator 34 protruding from slot 36 first has room to be in its extended position without forcefully contacting the wall so that magazine 38 can fall freely. By the time actuator 34 reaches the lower curved camming surface 152 there is enough energy for the actuator to be gently cammed inwardly by the receiver frame 29 without interfering with the free-fall release of magazine 38.

Figure 32:
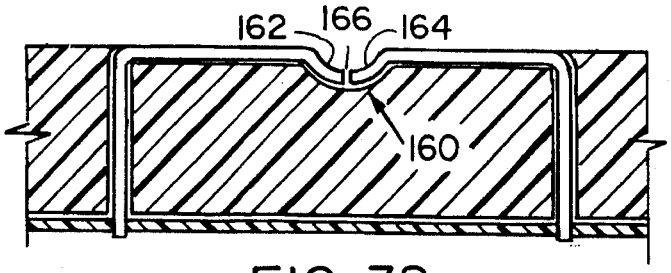
FIG. 32 is a side sectional view of another type of second switching element.
Figure 33:
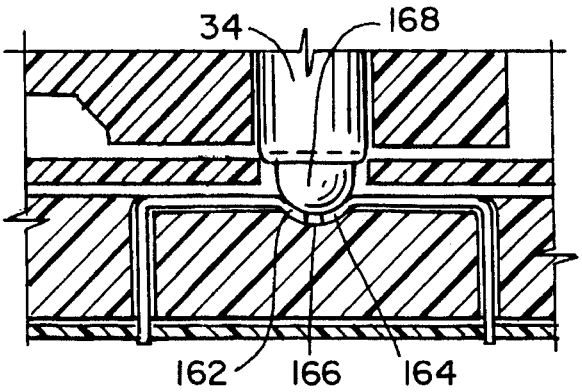
FIG. 33 is a view similar to FIG. 32 with the addition of the actuator positioned to short or close the switch element.
Figure 34:
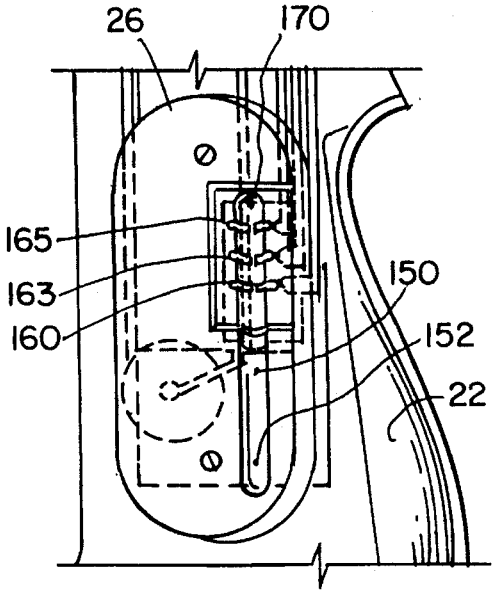
FIG. 34 is an elevational plan view of the switching device showing a gang of three switches as shown in FIGS. 32 and 33.

Another simpler type of switch element 160, FIG. 32, useful in this invention, includes simply two conductors 162 and 164 with a small space 166 between them. When the conductive tip 168, FIG. 33, of actuator 34 bridges gap 166, it shorts or connects conductors 162 and 164 to each other, thereby closing the switch. Three such switches 160, 163 and 165, FIG. 34, installed at groove 170 of plate 26 are actuated by the tip 168 of actuator 34 as it moves along in groove 170 with the follower element or intermediate element or some other part of the follower mechanism. The switch construction in FIG. 34 permits much higher packing density to be more compatible with smaller systems such as used with 22 caliber ammunition.

Figure 35:
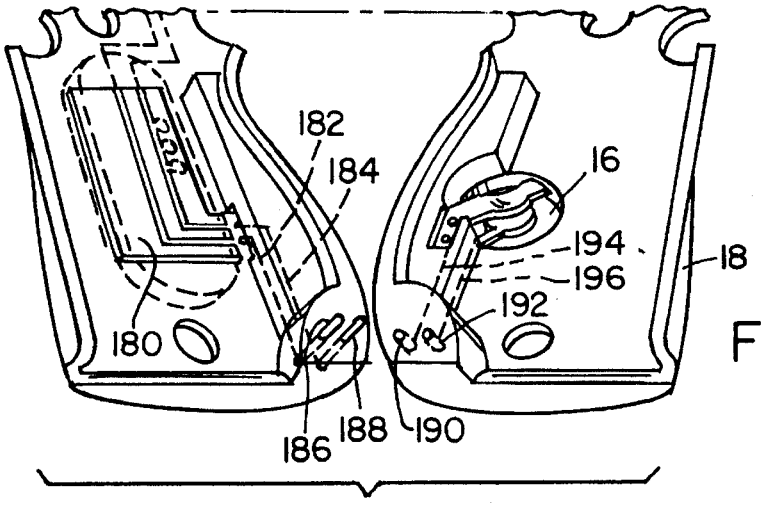
FIG. 35 is an axonometric view of two handle grips showing an alternative electrical interconnection between the grips.

In some constructions printed circuit boards 180, FIG. 35, may be desirable instead of the membrane construction. In that case, conductive paths between the battery in handle grip 18 and the other portions of the monitoring and indicator device may be made via conductors 182, 184, pins 186 and 188, sockets 190 and 192, and conductors 194 and 196.

Figure 36:
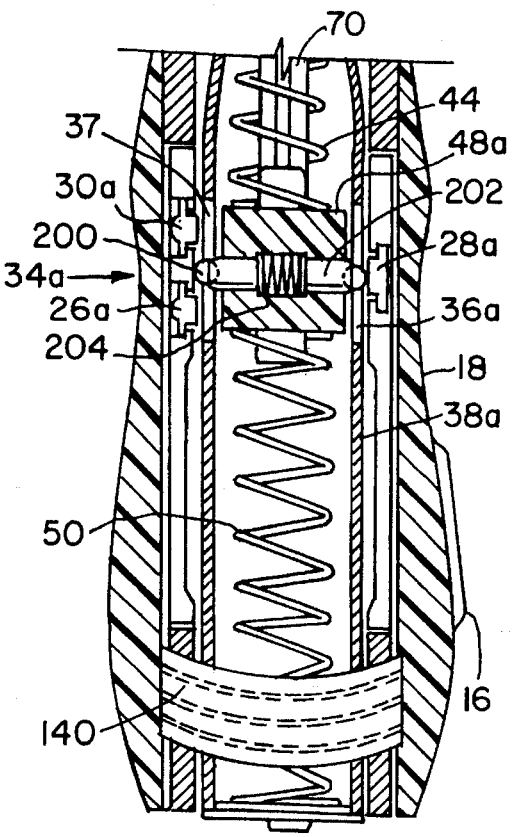
FIG. 36 is a cross-sectional view of a handle of a firearm showing a dual element actuator.

Although actuator 34 has been shown as a single ended actuator only, this is not a necessary limitation as actuator **34*a*, FIG. 36, may include one actuator element 200, 202 at each end at slots 36*a*, 37 with a biasing spring 204 between them. This provides two advantages. First, it enables switches 26*a* and 30*a* to be put on one side of magazine 38*a* and the middle switch 28*a* to be put on the other so that the switches can all be packed much more closely together. Further, it balances the forces between the magazine and the opposing walls of the magazine chamber so that magazine 38*a*** will remain better centered and will free-fall more readily when released.

Figure 38:
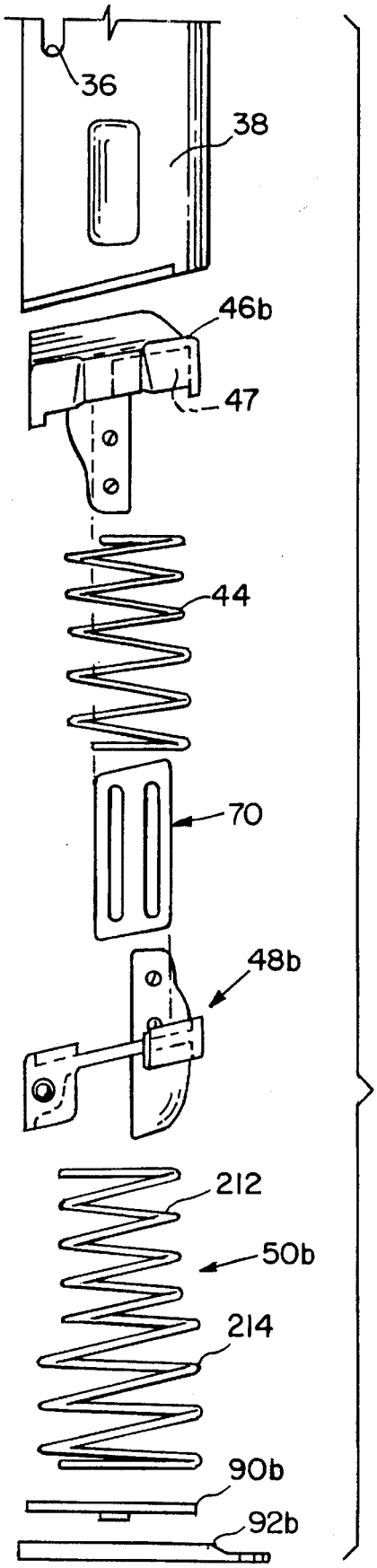
FIG. 38 is an exploded elevational view showing the magazine and complete follower mechanism using the intermediate element of FIG. 37.
Figure 37:
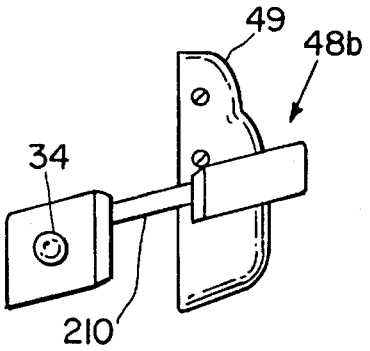
FIG. 37 is a side elevational view of an alternative follower mechanism intermediate element.
Figure 39:
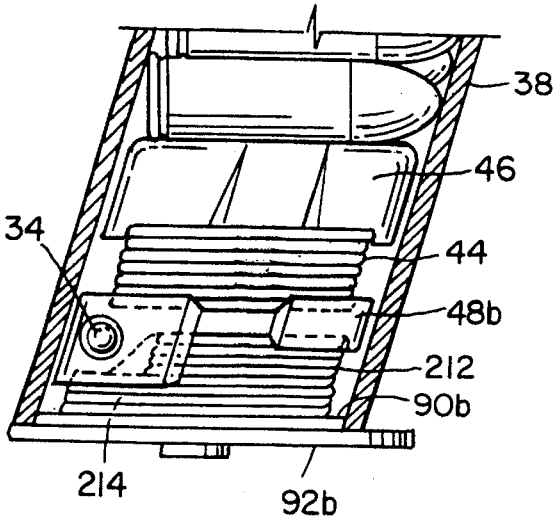
FIG. 39 is an enlarged detailed view of the follower mechanism of FIGS. 37 and 38 compressed in a fully loaded magazine.
Figure 40:
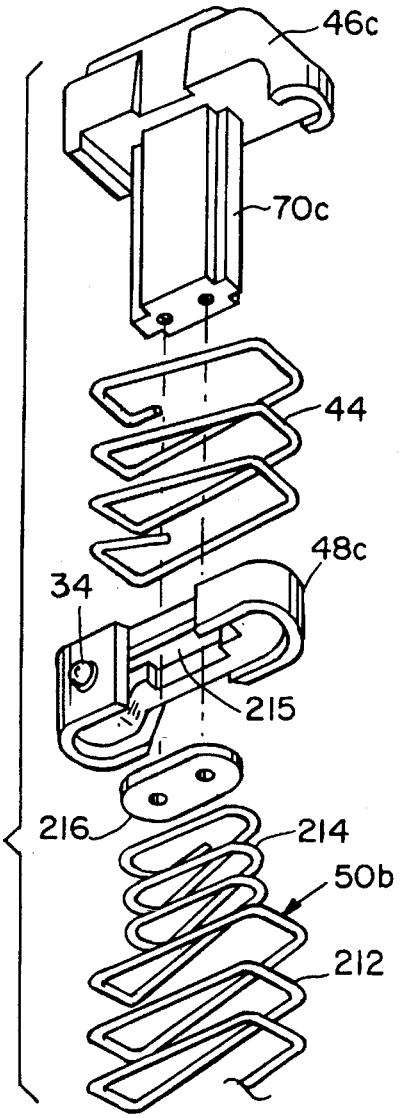
FIG. 40 is an exploded three-dimensional view of yet another follower mechanism.

A smaller, more compact follower mechanism may be constructed using an intermediate element **48*b*, FIG. 37, which has a narrower body 210 and thereby reduces the overall height or length of the follower mechanism. In this construction, lower spring 50*b* is formed in two sections: an upper section 212 and lower section 214, FIG. 38. Upper section 212 is of a reduced diameter so that it can nest farther up in the body of narrower profile intermediate element 48*b*, FIG. 39, leaving enough room at one end for the larger portion needed to house actuator 34, while at the same time the larger lower portion 214 is large enough to properly seat on the plate 90*b* of magazine base 92*b*. Since spring 44 is the strongest spring it expands first under full load of the magazine, spring section 214 expands next, and finally spring section 212 expands operating under the lightest load with only a few rounds left. The limiter may be implemented in another embodiment, FIG. 40, by a simple post 70*c* received in hole 215 of intermediate element 48*c* and limited in its movement by plate 216 which is mounted by screws, not shown, to the bottom of post 70*c***.

Figure 41:
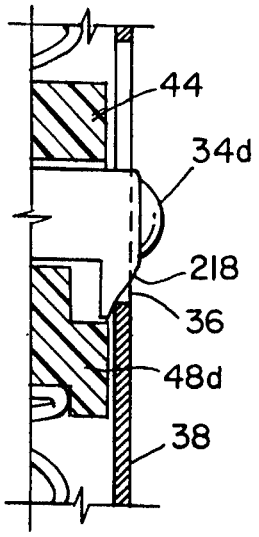
FIG. 41 is an enlarged detailed sectional view of an actuator having a camming surface to facilitate retraction of the actuator during loading of rounds into the magazine.
Figure 42:
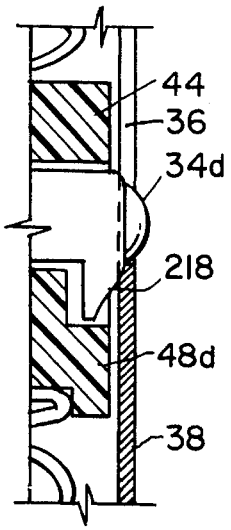
FIGS. 42 and 43 show the second and final steps in the retraction of the camming actuator of FIG. 41.
Figure 43:
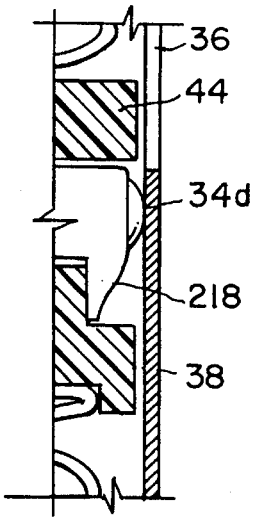

Another construction for facilitating the release of the magazine from the magazine chamber of the firearm is shown in FIG. 41 where actuator 34*d* includes a camming surface 218 that bears on slot 36 and causes actuator 34*d* to retract as intermediate follower member 48*d* moves downwardly in magazine 38 during the loading of the cartridges into the magazine. Its intermediate position is shown in FIG. 42 and its totally retracted position is illustrated in FIG. 43.

Figure 45:
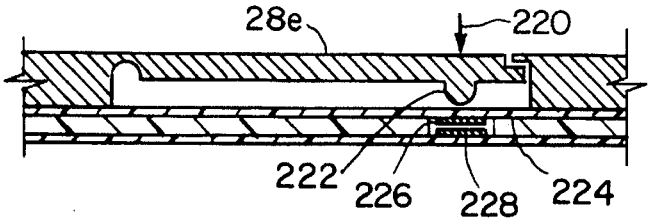
FIG. 45 is a side elevational view of one of the switch elements of FIG. 44.
Figure 44:
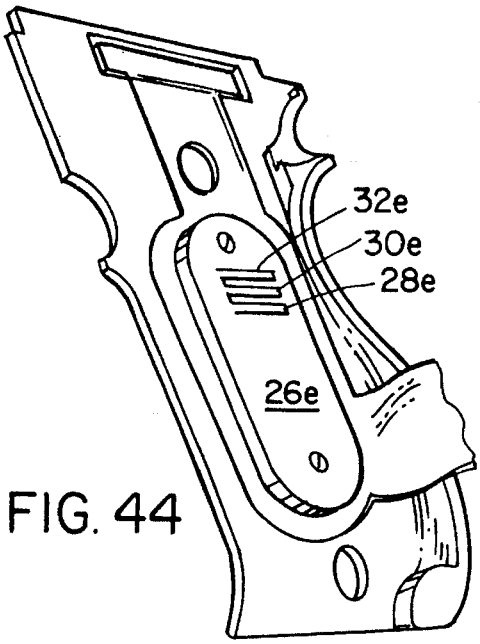
FIG. 44 is a three-dimensional view of a handle grip with an alternative second switching device.

In an alternative construction, switch operators 28*e*, 30*e* and 32*e*, FIG. 44, may be simple stampings or injection moldings on plate 26*e*, which create cantilevered fingers such as illustrated by finger 28*e*, FIG. 45, which can easily be pressed downwardly in the direction of arrow 220 to cause protrusion 222 to bear on the top of layer 224, thereby pushing contact 226 into electrical engagement with contact 228. Although not shown, any type of switch can be substituted in place of a membrane switch to be operated in conjunction with the described actuator system.

Figure 46:
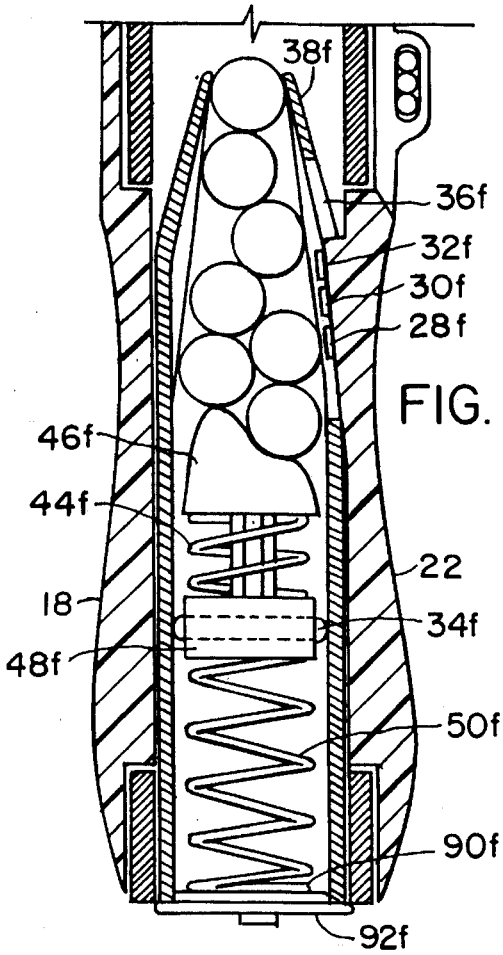
FIG. 46 is an elevational sectional view of a portion of the handle of a firearm with the second switching device protruding into the magazine.
Figure 47:
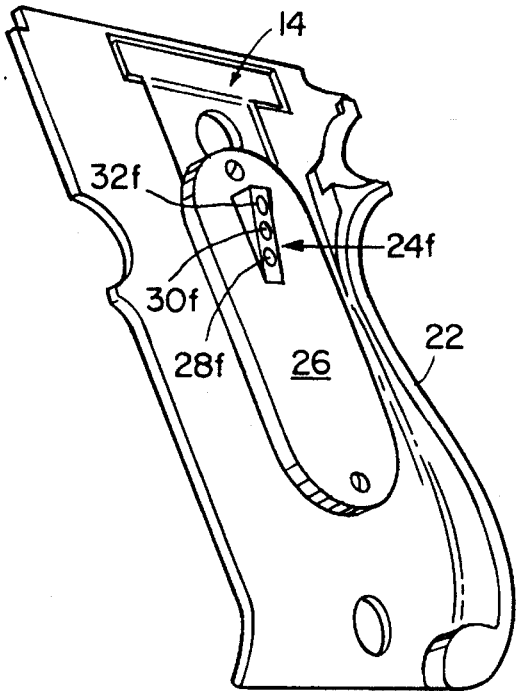
FIG. 47 is a three-dimensional view of the handle grip of the firearm with the switching device with the protruding switches of FIG. 46.

For magazines which have a tapered upper portion such as magazine 38*f*, FIG. 46, an opening 36*f* may be provided for permitting switching device 24*f* to protrude into the body of magazine 38*f* where it will be contacted by actuator device 34*f*. The raised angled position of switch operator elements 28*f*, 30*f* and 32*f* is shown to advantage in FIG. 47.

Figure 48:
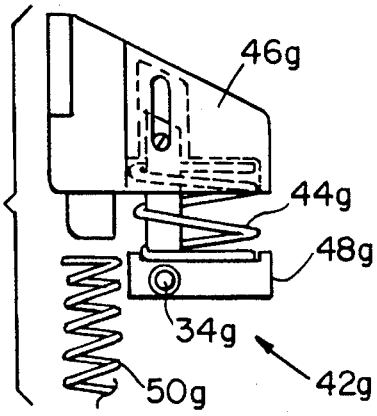
FIG. 48 is a side elevational view of another follower mechanism.

A follower mechanism 42*g*, FIG. 48, which is even more compact can be made where the springs line up next to each other, spring 44*g* which extends intermediate element 48*g* which carries actuator 34*g* still between intermediate element 48*g* and follower element 46*g*, spring 50*g* is connected directly to follower element 46*g* so that maximum use of the magazine capacity is not inhibited, as they compact side by side instead of on top of each other.

Figure 51:
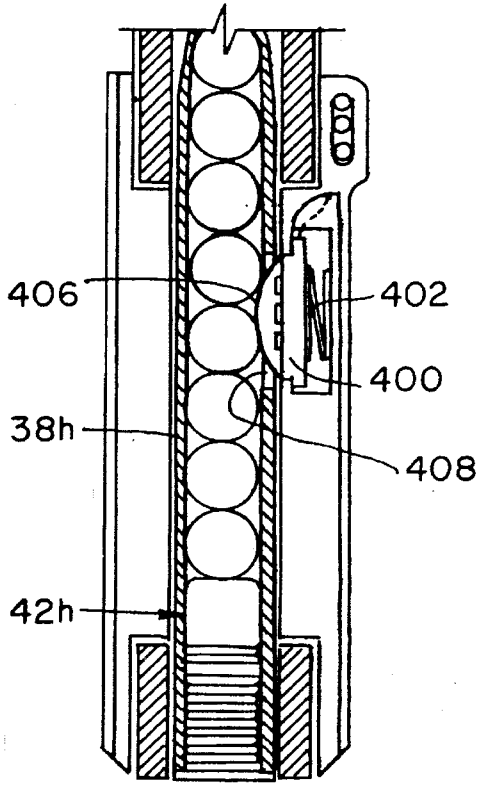
FIG. 51 is a view similar to FIGS. 49 and 50 with the magazine fully inserted and the switching device protruding into the magazine and contacting the rounds.
Figure 50:
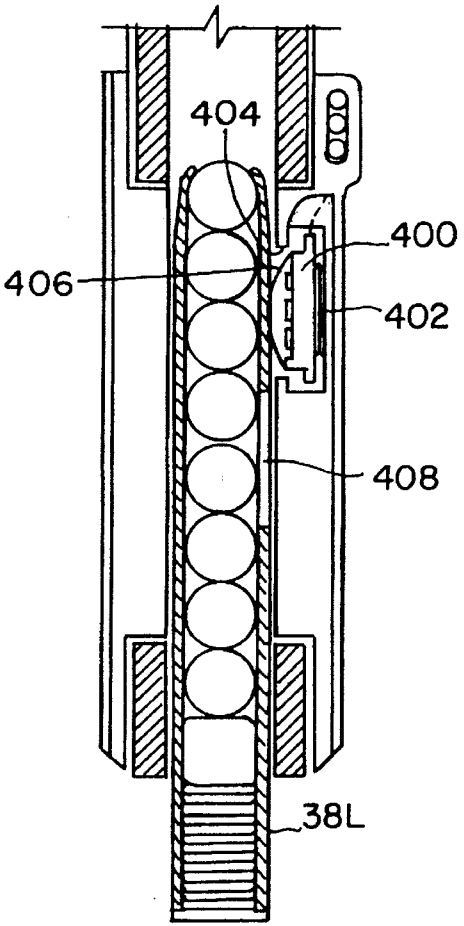
FIG. 50 is a view similar to FIG. 49 with the magazine further inserted and engaging the switching device.
Figure 49:
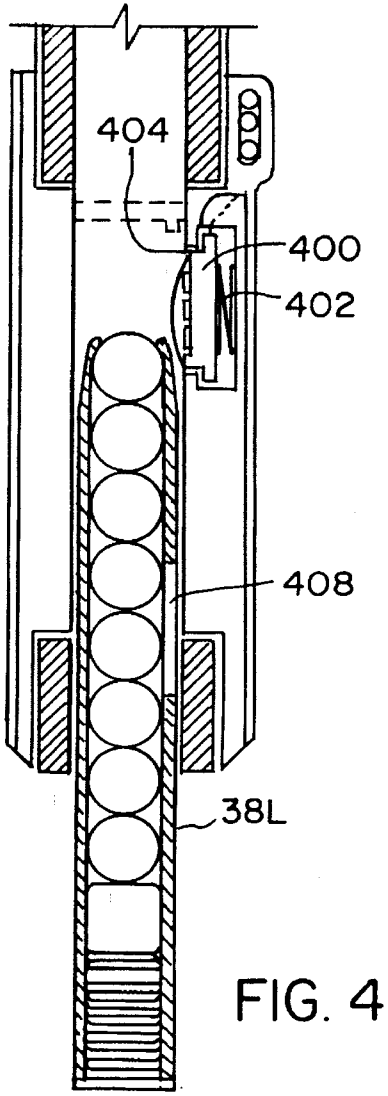
FIG. 49 is a schematic sectional view of the handle of a firearm showing an alternative spring loaded second switching device with the magazine partially inserted but not engaging the switching device.
Figure 53:
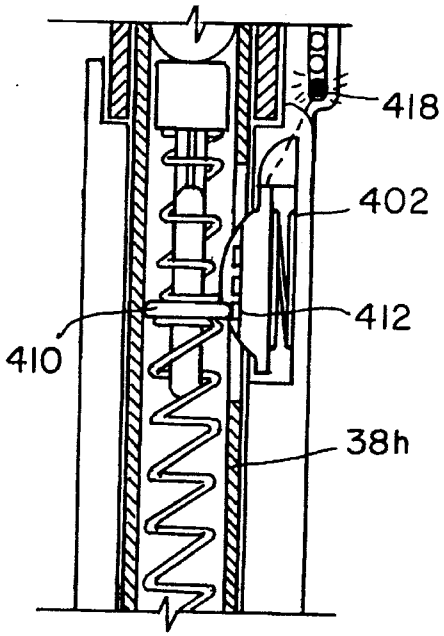
FIG. 53 is a view similar to FIG. 52 where the actuator has engaged the first of three switch elements indicating there are for example three cartridges left.
Figure 52:
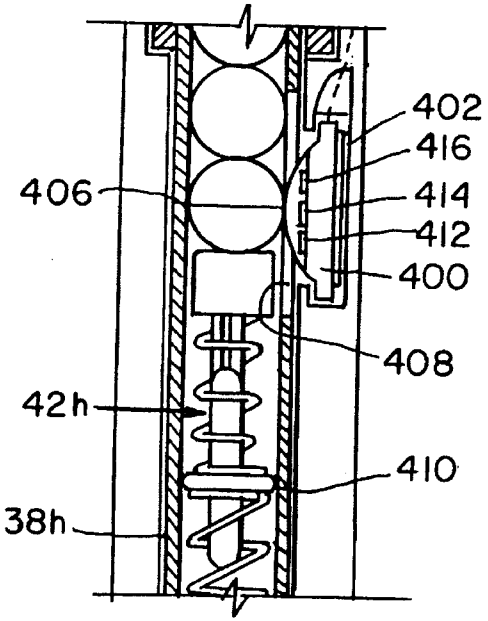
FIG. 52 is an enlarged detailed view of a portion of FIG. 51 before the actuator engages the switching device while there is still ample ammunition in the magazine.

In another configuration, the switching device may include a platform 400, FIG. 49, which is urged by spring 402 through hole 404 in the frame of a firearm. As magazine 38*h* with access hole 408 is inserted more fully, FIG. 50, the magazine pushes against camming surface 406 and drives platform 400 backward, collapsing spring 402, FIG. 50. When magazine 38*h* is fully seated, FIG. 51, platform 400 lines up with hole 408 in magazine 38*h*. Now, as the cartridges are expended and the follower mechanism 42*h* moves upwardly, actuator 410, FIG. 52, approaches access aperture 408, platform 400, and switches 412, 414 and 416, eventually, as shown in FIG. 53, actuator 410 engages the first of the switches 412 and lights an indicator light 418. Now, as the cartridges are stripped from the magazine 38*h*, FIGS. 51, 52, and the follower mechanism 42*h* moves upwardly, the camming surface 406 which is urged into the cartridges by spring 402, allows the cartridges to go freely by.

Figure 54:
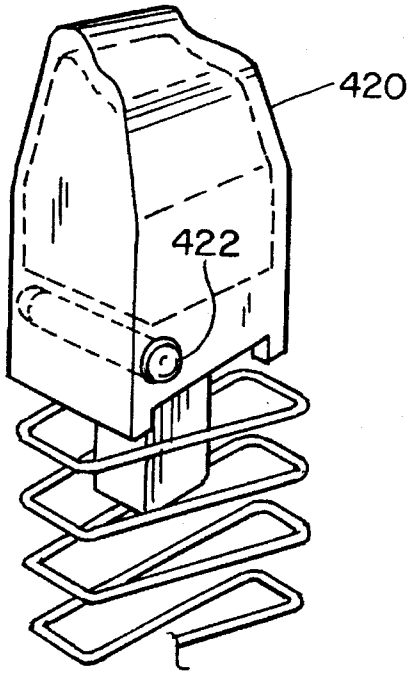
FIG. 54 is an enlarged detailed view of a portion of another follower mechanism consisting of a single follower element with a double actuator mounted in it.

When the configuration of the gun frame is designed with an access aperture high enough to be compatible with a magazine aperture, the follower itself may carry the actuator 422 as shown in FIG. 54, where the follower 420 carries dual ended actuator 422.

Figure 55:
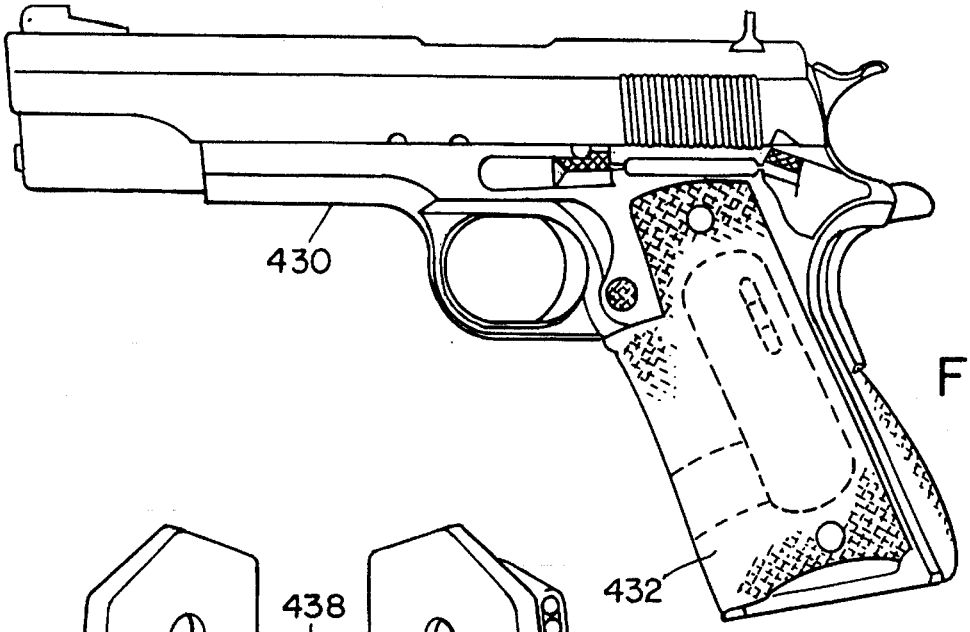
FIG. 55 is a side elevational view of a firearm showing two hand grips formed from a single piece which wraps around the front of the handle.
Figure 56:
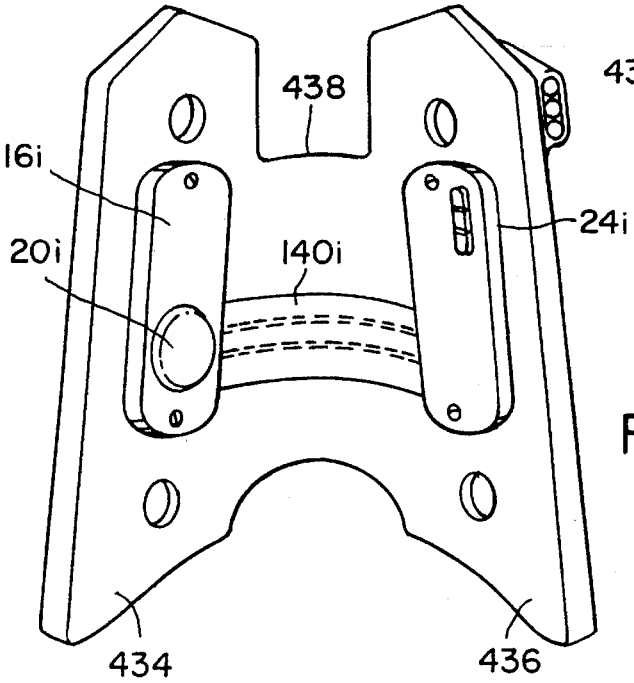
FIG. 56 is a three-dimensional view of the inside of the hand grip of FIG. 55 removed from the firearm assembly.
Figure 57:
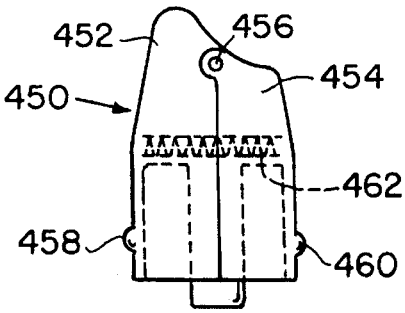
FIG. 57 is a side elevational view with portions shown in phantom of a split follower with double actuators.
Figure 58:
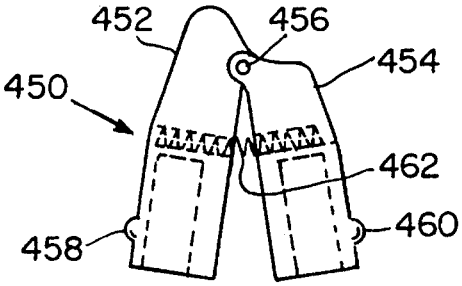
FIG. 58 is a view similar to FIG. 57 with the follower in the open condition whereby the actuators can operate a switching device.

While thus far the interconnection between the circuitry in the opposite handle grips has been made through interconnection around the back of the firearm handle, this is not a necessary limitation. As shown in FIG. 55, the firearm 430 has an integral handle grip arrangement 432 in which the left 434 and right 436 handle grips are interconnected by member 438, FIG. 56, which wraps around the front of the firearm handle and carries membrane 140*i*. Note also in this configuration battery housing 16*i* is totally contained within the handle grips and does not protrude at all on the outside. The actuator and follower functions can be provided simultaneously by the same device as shown in FIG. 57, where follower 450 is split into two sections 452 and 454 rotatably connected at hinge 456. Each section 452 and 454 has an actuator detent 458 and 460. Thus when the slots are encountered in a magazine, spring 462 will urge apart sections 452 and 454, as shown in FIG. 58, causing actuator detents 458 and 460 to engage associated contacts.

Figure 59:
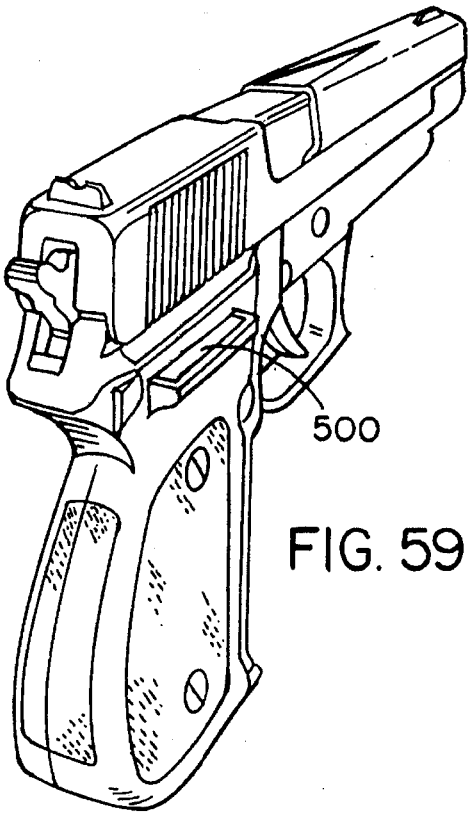
FIG. 59 is a right side perspective view of a firearm showing an alternative mechanical indicator device.
Figure 60:
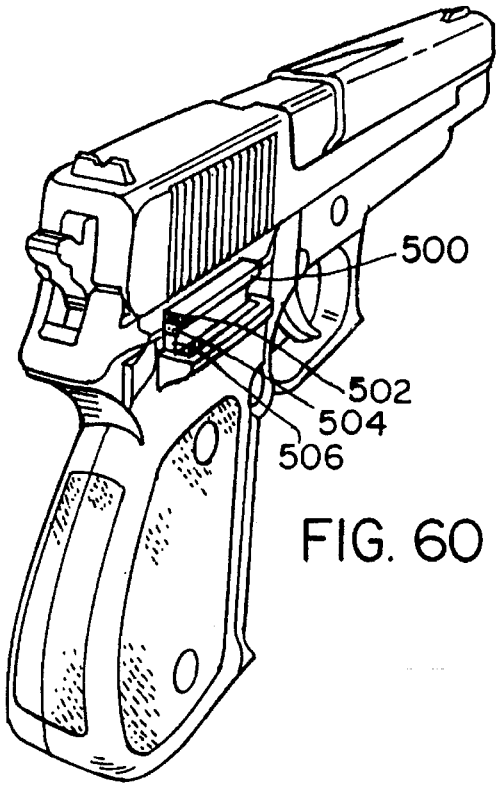
FIG. 60 is a view similar to FIG. 59 with the mechanical indicating device token in the alarm condition.
Figure 61:
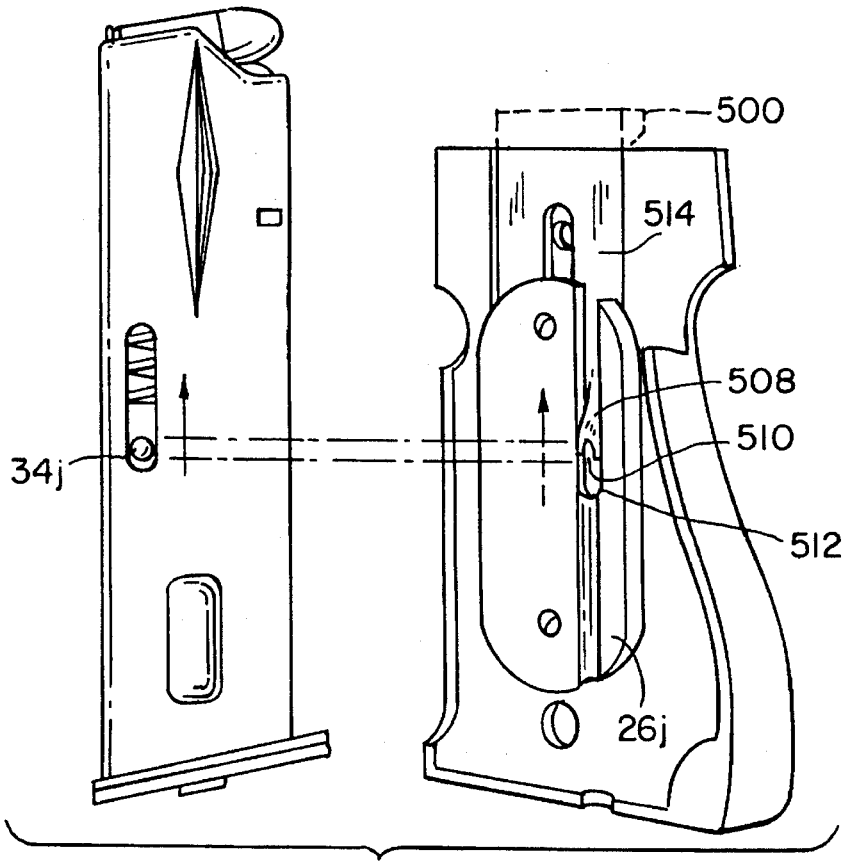
FIG. 61 is an axonometric view of a magazine and actuator and the mechanical monitoring device which operates with the mechanical indicator device of FIGS. 59 and 60.
Figure 62:
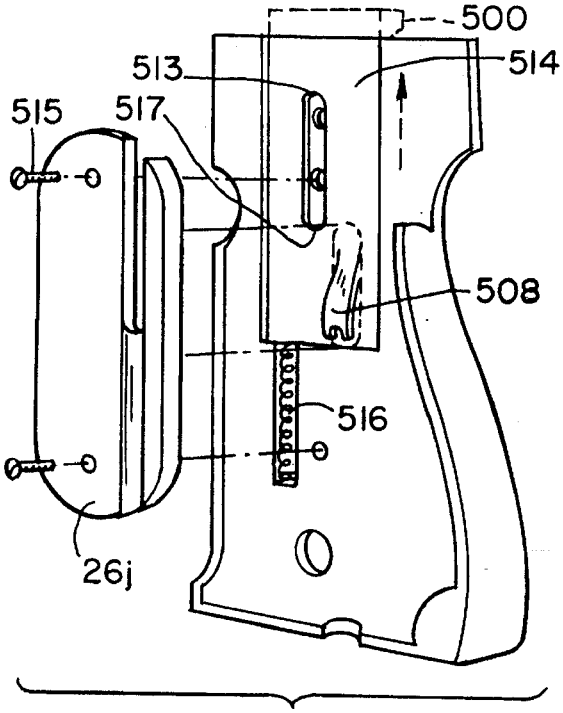
FIG. 62 is an exploded perspective view of the handle grip of FIG. 61 showing in more detail the parts of the mechanical monitoring and display device.

Although thus far the automatic monitoring and indicator system has been shown implemented electrically, this is not a necessary limitation. The indicator device may be a mechanical token 500, FIG. 59, which may begin to rise up in steps as the predetermined level of cartridges is reached. For example, the end of token 500, FIG. 60, could be a single color to indicate when no more cartridges are left, or it could be sectioned in three colors 502, 504, 506, which become visible selectively, serially as the cartridges are expended. Such a device in a typical actuator 34*j*, FIG. 61, would engage with a tongue 508, FIG. 61, which contains a groove 510 for receiving actuator 34*j*. Actuator 34*j* then lifts tongue 508. Tongue 508 moves up and down in slot 512 of plate 26*j*. Tongue 508 is a part of slider 514 at the top end of which is carried token 500. A return spring 516, FIG. 62, ensures that slider 514 and token 500 return to their retracted position when the magazine is withdrawn. Tongue 508 also allows the magazine to easily slide by for insertion and release. There is also a recess or slot 513 to accept slider 514. Screw 515 acts as a stop by engaging the lower end 517 of slot 513. Also tongue 508 can fall into the magazine to engage a slot or lifting element, not shown, to be driven upwards.

Figure 65:
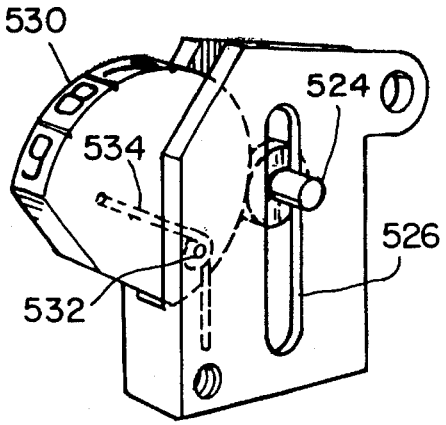
FIG. 65 is a view of the monitoring and indicator system of FIG. 64 in an alarm condition.
Figure 64:
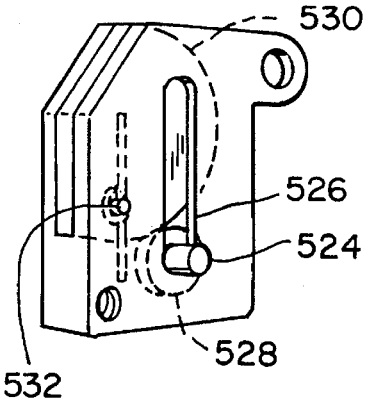
FIG. 64 is a three-dimensional view of the monitoring and indicator system of FIG. 63.
Figure 63:
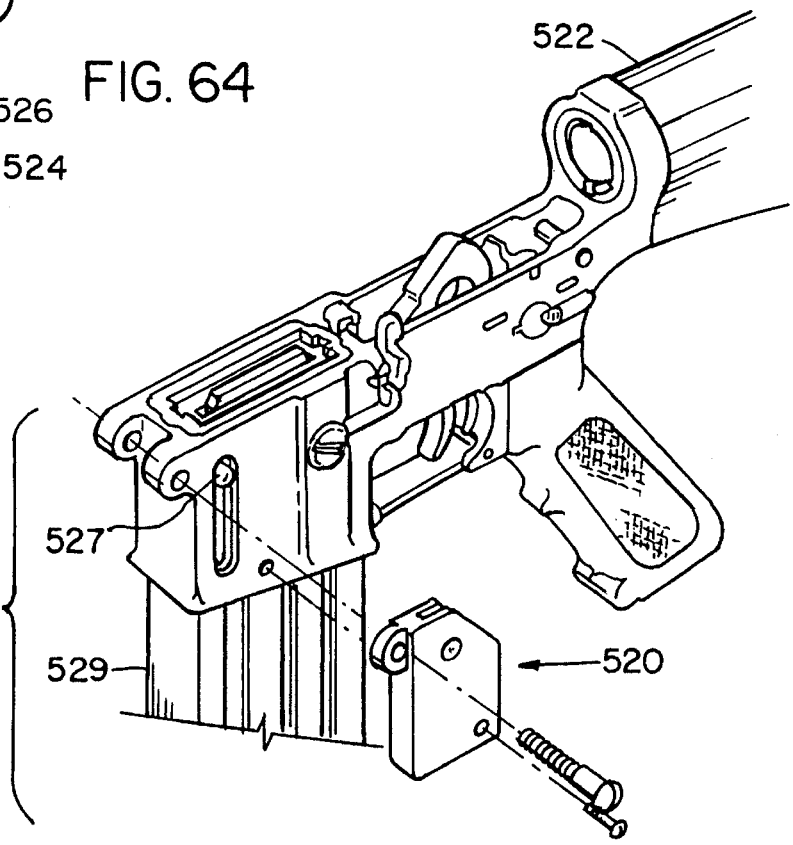
FIG. 63 is a left side perspective view of a rifle employing another form of mechanical monitoring and indicator system.

Another mechanical implementation of the monitoring and indicator system 520 is shown in FIG. 63 mounted to a rifle 522. System 520 includes slider 524, FIG. 64, mounted through slot 526. Slider 524 has an enlarged flange 528 which bears on token 530 rotatably mounted for rotation about pivot 532. As slider 524 is driven upwardly, FIG. 65, in slot 526 by actuator 527 of magazine 529, FIG. 63, it causes token 530 to rotate outwardly displaying numbers which indicate the number of cartridges spent or remaining. The return spring 534 returns token 530 and slider 524 to the start position when the magazine is removed from the magazine receiver in rifle 522.

Figure 66:
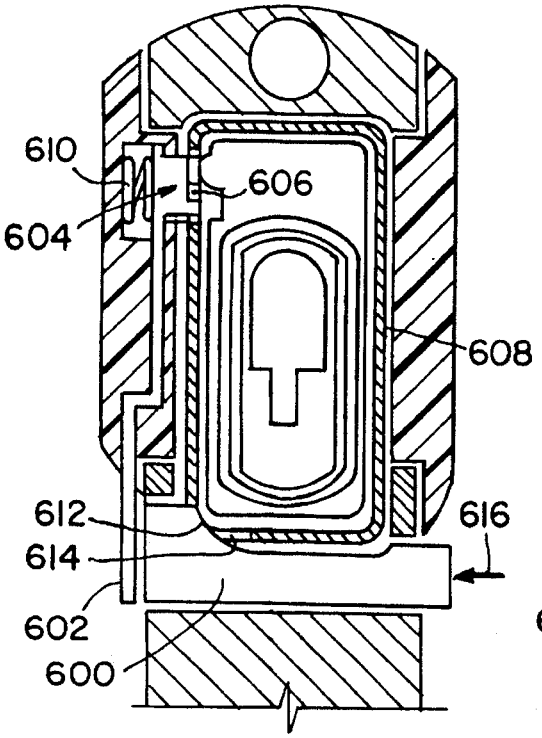
FIG. 66 is a top sectional view of a retractor mechanism for a switching device operable in conjunction with the magazine release.
Figure 67:
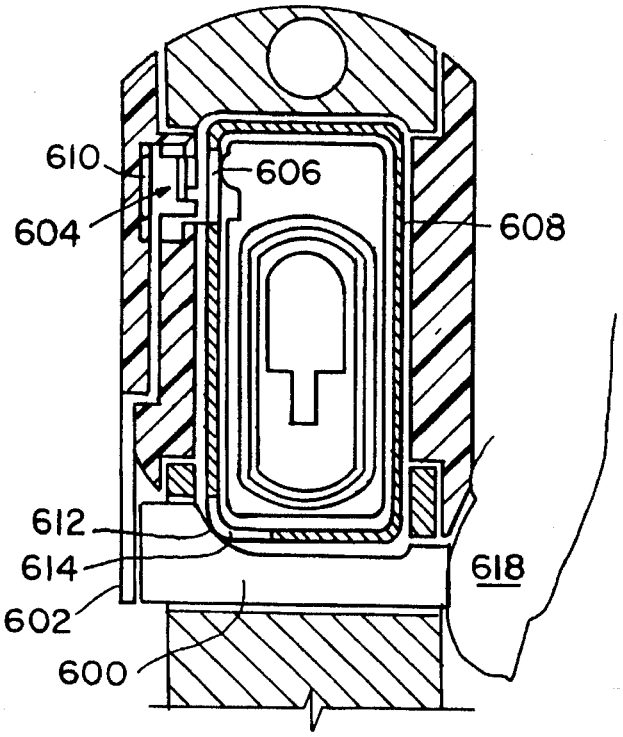
FIG. 67 is a view similar to FIG. 66 with the switching device retracted by operation of the magazine release.

A combination magazine release and switching device retractor is shown in FIG. 66, where magazine release 600 contacts switch extension 602 of switching device 604 urged outwardly through hole 606 in magazine 608 by spring 610. When the magazine 608 is locked in the magazine chamber, a shoulder 612 of release 600 is nested in opening 614 in the corner of magazine 608. However, when release 600 is pushed in the direction of arrow 616 by finger 618, FIG. 67, release 600 not only removes shoulder 612 from opening 614, thereby releasing magazine 608, it also drives switch extension 602 to the left, compressing spring 610 and withdrawing switching device 604 from access hole 606, thereby permitting the magazine to free-fall quickly and easily.

Although thus far the monitoring and indicator system has been illustrated as adapted for retrofitting to existing firearms, this is not a necessary limitation of the invention: it can be even more easily adapted to original equipment designed to accept it initially as in FIG. 68, where for example the battery has been shown housed within the frame of the firearm, typically within the handle grips. In one variation the battery may be placed in a housing 700, interconnected by cable 702 to housing 704 which contains both the indicator device and monitoring device.

Figure 69:
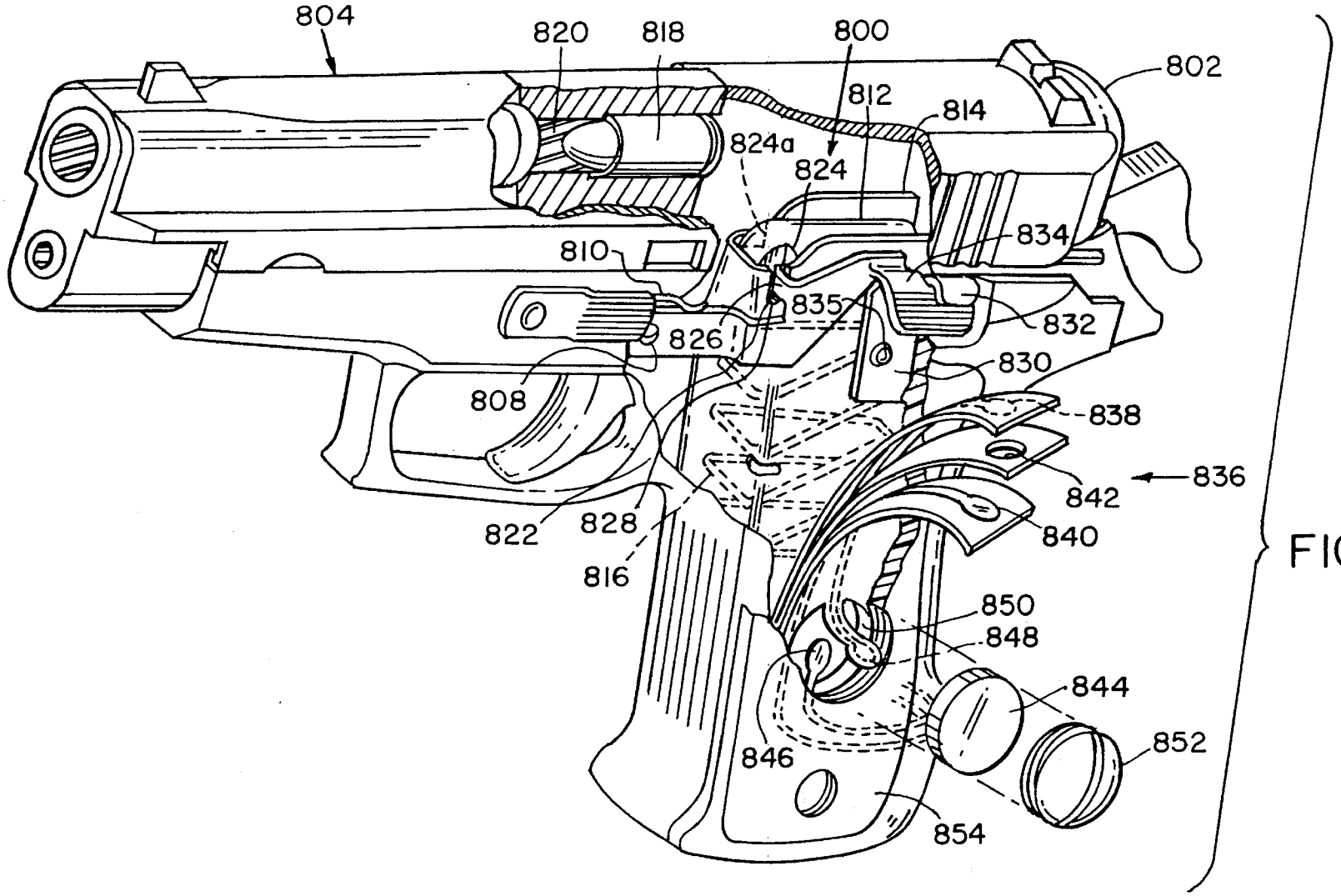
FIG. 69 is a three-dimensional view of an automatic pistol with portions broken away to show the breech block catch lever and associated circuitry according to this invention before the last cartridge is expended.

The first switching circuit 800 which monitors the position of the breech block or slide 802 of firearm 804, is shown in FIG. 69. Catch lever 806 is pivotally mounted at screw 808 and normally biased downwardly by spring 810 where it could not interfere with the action of slide 802. When the follower 812 in magazine 814, under the urging of spring 816, has driven the last cartridge 818 from magazine 814 so that that cartridge rests in chamber 820, base 822 of notch 824 in follower 812 engages tab 826 of catch lever 806 that extends through slot 828 of magazine 814. At this point the force of spring 816 is sufficient to cause follower 812 to drive tab 826 and thus catch lever 806 upwardly against the force of spring 810, except for the fact that breech block or slide 802 is forward and mechanically prevents that motion. Operator 830, which has a lip 832 folded over and engaging the distal portion 834 of catch lever 806, carries on it a prominent portion 835 which when raised by the motion of catch lever 806, engages the membrane switch 836 or activates any type of electrical switch so that its contacts 838 and 840 makes contact with each other through aperture 842 and close the circuit connecting the battery 844 normally housed between battery contacts 846 and 848 to energize or deenergize a light or other visual, audio or other types of alarms. Battery 844 is received in recess 850 accessible by means of a threaded waterproof cap 852 in handle 854 of firearm 804.

Figure 70:
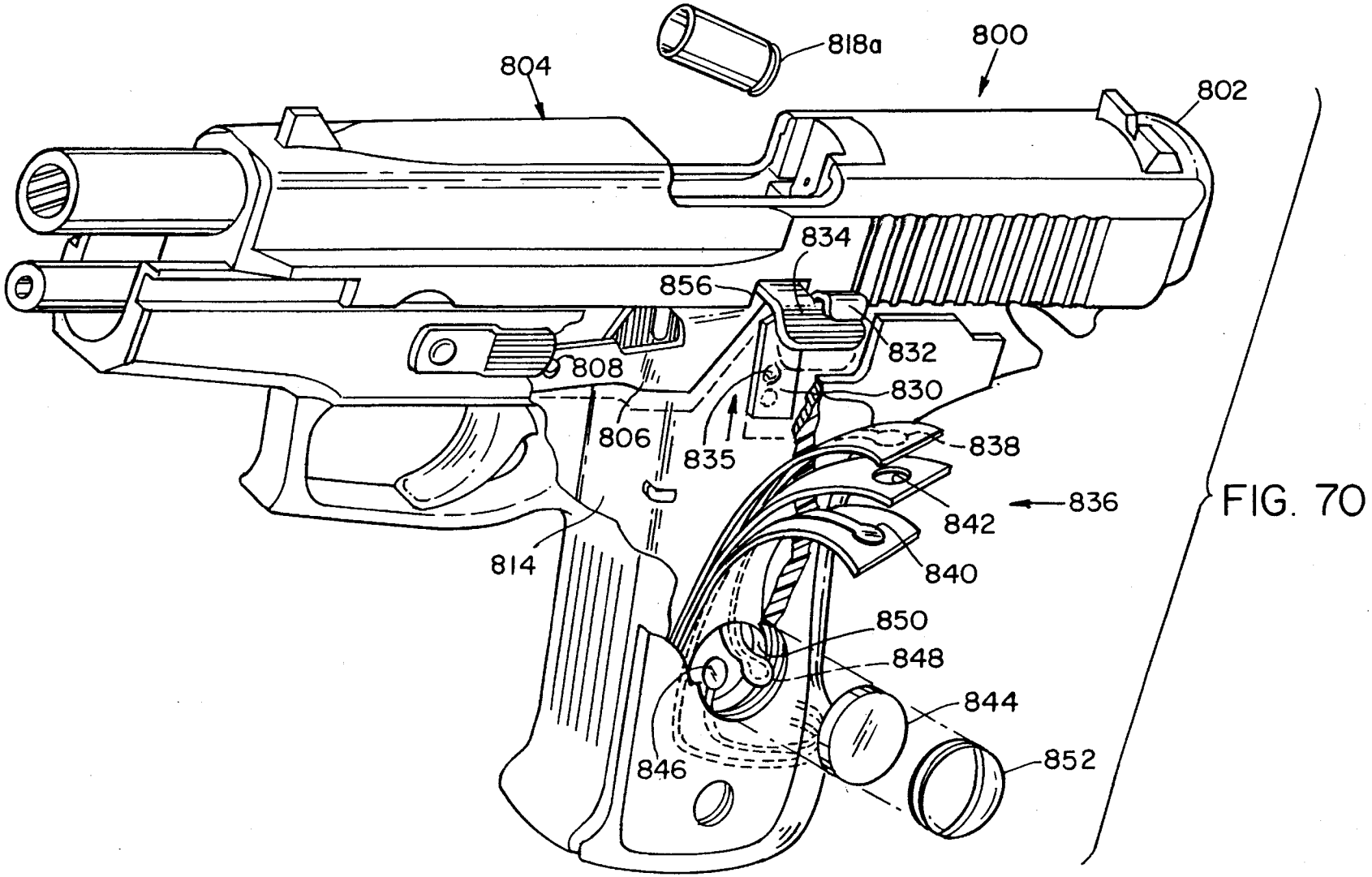
FIG. 70 is a view similar to FIG. 69 after the last cartridge has been expended and the breech block is locked in the open position.

After the last cartridge has been fired, FIG. 70, and the empty shell 818*a* has been ejected, slide 802 is driven into the rearmost position so that under the urging of magazine spring 816 the distal end 834 of catch lever 806 can be raised to engage and lock in notch 856 in slide 802. In this condition distal end 834 of catch lever 806 has engaged folded portion 832 of operator 830 and lifted it so that prominent portion 835 moves up and presses contact 838 into engagement with contact 840 to close the circuit.

Figure 71:
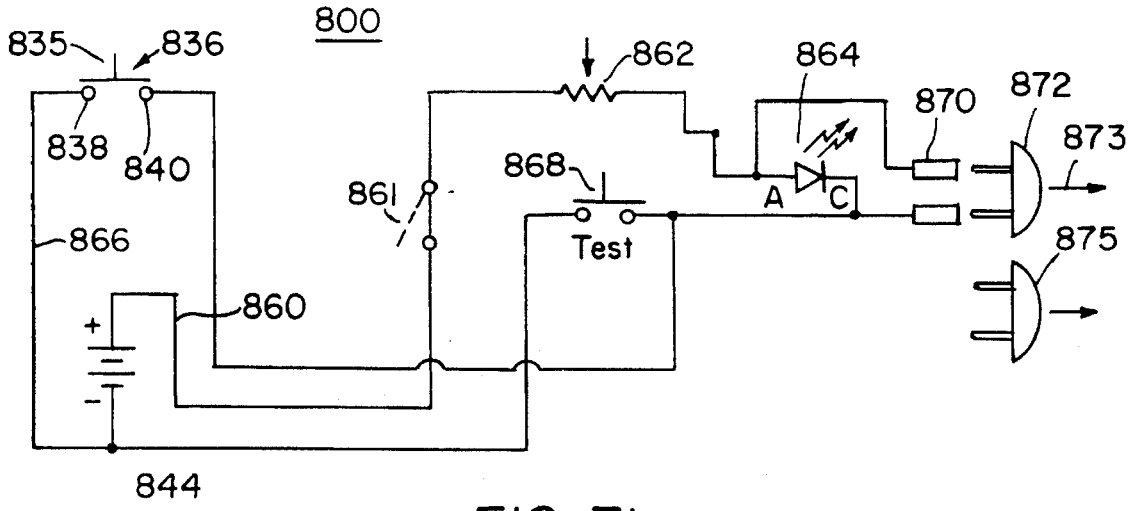
FIG. 71 is a simplified schematic diagram of the circuit of FIGS. 69 and 70.

A simplified schematic of switching circuit 800 is shown in FIG. 71, where the positive side of battery 844 is connected over line 860 through an intensity controlling variable resistance 862 to LED display 864 which lights to indicate that magazine 814 is empty, chamber 820 is empty, and slide 802 is back and locked by catch lever 806. The negative side of battery 844 is connected through line 866 to the other side of switch 836. A test switch 868 may be used to test the operation of LED 864. In addition, a pair of contacts 870, normally capped by a dummy plug 875, may be used to provide that signal to a remote location, or to a remote device in or around the person using the firearm via remote data plug 872 which communicates over cable 873 to operate a remote signal or alarm device instead of or in tandem with LED 864. An on/off switch 861 shown in phantom lines could be provided if so desired. An actual implementation of the first circuit is shown in more detail in FIG. 72. Left and right grips 874 and 876 each contain a recess 878 and 880, respectively, for containing the membrane for receiving the left and right sections 882 and 884 of membrane circuit 886. Sections 882 and 884 are interconnected by section 888 which wraps around the butt or handle 890 of firearm 804. Sections 882 and 884 are fastened to their respective grips 874 and 876 by holding plates 892 and 894 and screws 896 and 898. Grips 874 and 876 are mounted to handle 890 by screws 900 and 902, respectively, which engage with threaded holes in handle 890. LED 864, intensity adjustment resistor 862, and test switch 868 along with remote data plug socket 871 designed to accept remote data plug 872 and dummy plug 875 through aperture 915 at front end of recess 906 are mounted in housing block 904 which is received in recess 906 in grip 876. Holes 908 and 910 are provided for access to variable resistor 862 and to make accessible actuator button 912 of test switch 868. An aperture 914 at the rear end of recess 906 is provided so that the user can easily view the condition of LED 864. Dummy plug 875 safely closes the socket when remote data access plug 872 is not used.

Figure 73:
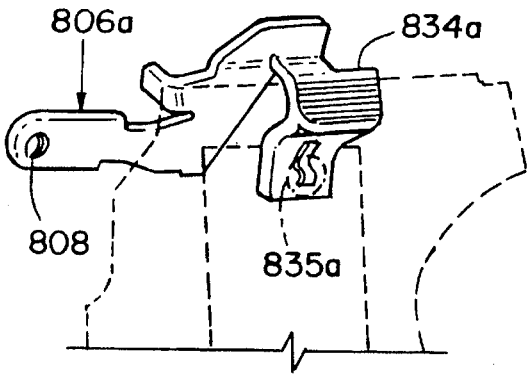
FIG. 73 is a three-dimensional view of a breech block catch lever according to this invention with an integral switch operator.
Figure 74:
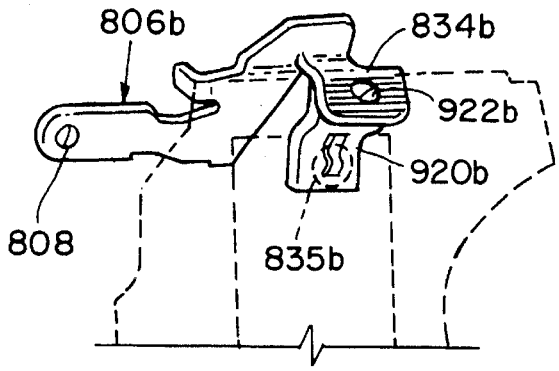
FIG. 74 is a three-dimensional view of an alternative form of a breech block catch lever according to this invention with a separable integral switch operator.
Figure 75:
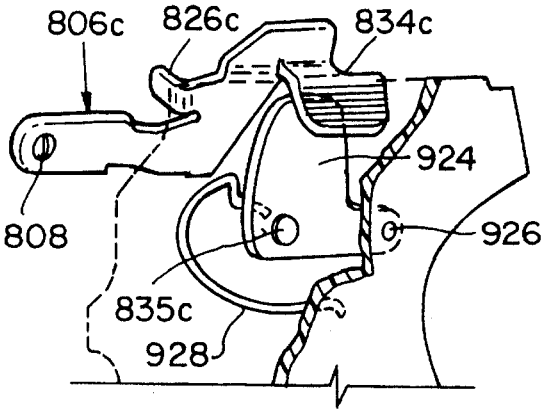
FIG. 75 is an three-dimensional view of an alternative form of a breech block catch lever according to this invention with a separate switch operator biased to operate the switching circuit and inhibited from doing so by the catch lever.
Figure 76:
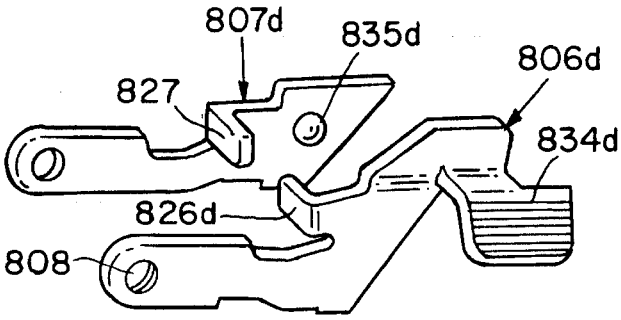
FIG. 76 is a three-dimensional view of an alternative two-part independent action breech block catch lever according to this invention.
Figure 77:
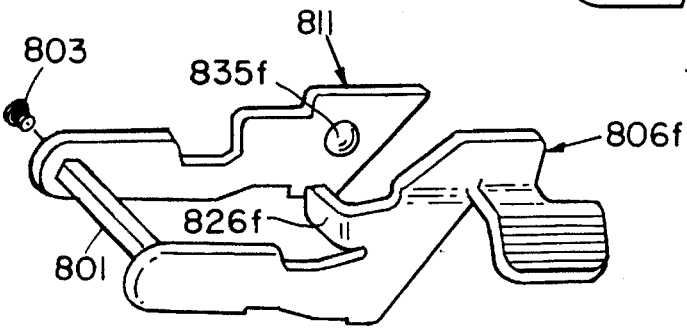
FIG. 77 is a three-dimensional view of an alternative three-part integral action breech block catch lever and switch operator lever according to this invention.

The catch lever and operator may take a number of different forms. They could be designed to replace OEM originals as an after-market product or designed as original equipment. For example, catch lever 806*a*, FIG. 73, may have operator 835*a* mounted directly on its distal end 834*a*. Or, as shown in FIG. 74, the lower section 920*b* of distal end 834*b* need not be integral with the rest of the distal end as shown in FIG. 73, but may be releasably attached thereto by means of screw 922*b*. Alternatively, operator member 835*c* may include a camming member 924 pivotally mounted at 926 and urged upwardly by spring 928 against the distal end 834*c* of catch lever 806*c*. When the last round has been expended from the firearm the follower then engages drive tab 826*c*, catch lever 806*c* is now driven upward so that distal portion 834*c* will permit operator 924 to rotate and raise operator button 835*c* to actuate the switch. A fourth alternative is shown in FIG. 76 where catch lever has two sections, a normal catch lever 806*d* and a separate switch operator lever 807*d*. Both are driven upward by the follower engaging drive tabs 826*d* and 827. While catch lever 806*d* functions to lock back the slide 802, lever 807*d* can be used to operate any switch. Follower 812 has a second notch 824, FIG. 69, cooperating with lever 807*d*.

Although thus far in FIGS. 73–76 the various catch levers have been shown using a screw, e.g. 808, as the pivot pin, this is not a necessary limitation of the invention, as a conventional pin or shaft could also be used. For example, in FIG. 77 the catch lever 806*f* and separate switch operator lever 811 can be integrally interconnected by pin or axle 801 so that they rotate together as a unit. Axle 801 has a non-circular cross section to insure that it cannot rotate relative to levers 811 and 806*f*. If axle 801 is round or even if it is not circular, a screw 803 can be used to secure it to lever 811 to make a unified three section 811, 801, 806*f* unit that acts as an integral element for pivotal rotation. The other end of axle 801 is typically formed as one, or force fitted, with lever 806*f*. The unified operation of lever sections 811 and 806*f* enables the switch to be placed on the opposite side of the firearm from the catch lever with little or no modification to the firearm itself.

When the first switching circuit described in FIGS. 69–77 is combined with the second switching circuit as described in FIGS. 1–68, combined switching system 930, FIG. 78, appears similar to circuit 800, FIG. 71, with the exceptions that the second switching system 932 includes three switches, red 934, yellow 936, and green 938, which control the red, yellow and green LEDs 864*e*, 864*ee* and 864*eee*. When there are three cartridges left, two in the magazine and one in the chamber, green switch 938 is closed by switching circuit 932 and green LED 864*eee* is lighted. When there are but two cartridges left, one in the magazine and one in the chamber, switch 936 is closed and yellow LED 864*ee* is lighted. Finally, when there is one cartridge left in the chamber, switch 934 is closed, energizing red LED 864*e* which will remain energized until the empty magazine is ejected from the firearm. If and only if slide 802, FIG. 69, is locked in its rearmost position by catch lever 806 which closes switch 836*e*, then power is delivered from battery 844*e* over line 866*e* to both the yellow contact 940 and the green contact 942. Thus the indication that the firearm is empty and the slide is back and locked in its open position occurs when switch 836*e* is closed, providing a clear and compelling indication of the condition of the firearm.

In operation then, if the red light is lit and the firearm stops firing and the yellow and green lights are energized, that indicates that the catch lever is up and the breech block is locked open. It also means that the magazine and chamber are empty since the catch lever can only be up when the follower is at the top of its travel in an empty magazine. That the magazine is empty is also confirmed by the fact that the second switching circuit has sensed an empty magazine and lit the red light. With all three lights lit green, yellow, and red the indication is that the firearm is in a first state: out of ammunition with the breech locked open, and is not malfunctioning.

If on the other hand the firearm stops firing and no lights are lit or only one light, the green, the yellow, or the red, is lit, the indication is that the firearm is in a second state: it is jammed or malfunctioning. If the red light is lit but the yellow and green are not that means the magazine is out of ammunition but the catch lever is not up and the breech is not locked open: there is a malfunction.

This invention can also display a third state in which the user is reminded by the indicator (which is activated when the breech block is locked in the open position by the catch lever) to release the breech by operating the catch lever to chamber a cartridge, thereby deactivating the indicator. When used in conjunction or combined with the second monitoring switch circuit, the third state is displayed upon the empty magazine being ejected which deenergizes the red light, leaving the green and yellow lights lit by the first circuit. Thus the third state is now displayed. Upon inserting a new, full magazine into the firearm the user immediately knows or is reminded to operate the catch-lever releasing the breech to chamber a cartridge, thereby deenergizing the green and yellow lights.

The invention thereby provides clear and compelling indications of the firearm's condition which are reliable and unambiguous and which immediately attract the attention of the user even under the stress of a firefight and even in low light conditions. The term breech block is a generic term as used herein, encompassing all manner of automatic self loading weapon mechanisms, e.g., the slide mechanism on a pistol, the bolt on a rifle or shotgun.

The invention thereby provides clear and compelling indications of the firearm's condition which are reliable and unambiguous and which immediately attract the attention of the user even under the stress of a firefight and even in low light conditions.

Various combinations of colors or different types of alarms can be used to indicate that the magazine and chamber are empty and the slide is locked back and that therefore the firearm is truly empty of cartridges and not simply jammed or malfunctioning. The implementation of this circuit in the handle grips of the firearm is shown in more detail in FIG. 79. The second switching circuit is implemented by pairs of switch contacts which are sequentially closed by actuators 950 and 952 on intermediate follower 954 disposed between springs 956 and 958 which drive primary follower 960.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. An alarm system for distinguishing between an empty and a malfunction condition for a firearm having a breech block catch lever operated by a magazine follower to lock the breech block in the open position when the firearm has been fired empty of all cartridges, comprising:

an indicator device; and a switching system, responsive to the catch lever being operated by the magazine follower to lock the breech block in the open position, for setting said indicator device to a first state to represent that the magazine and chamber are empty and the breech block is locked open and not malfunctioning and responsive to the catch lever being unoperated and the breech block being free for setting said indicator device to a second state to represent that the firearm has stopped firing because of a malfunction.

2. The alarm system of claim 1 in which said switching system includes a first switching circuit responsive to the catch lever being operated or unoperated by said magazine follower for setting said indicator device selectively to said first and second states.

3. The alarm system of claim 2 in which said switching system includes a second switching circuit including an actuator movable with the follower and a monitoring device disposed along the path of the follower and operable by said actuator to monitor the level of the follower and the level of cartridges in the magazine and chamber and set said indicator device to represent the level of cartridges in said magazine and chamber.

4. The alarm system of claim 2 in which said first switching circuit includes a switch element and an operator for operating said switch element.

5. The alarm system of claim 4 in which said operator is on said catch lever.

6. The alarm system of claim 5 in which said operator is integral with said catch lever.

7. The alarm system of claim 5 in which said operator is securable to said catch lever.

8. The alarm system of claim 4 in which said operator is independent of but operated by said catch lever.

9. The alarm system of claim 6 in which said operator is pivotably mounted on said firearm and is spring biased against operation by said catch lever.

10. The alarm system of claim 4 in which said operator is disposed on the opposite side of said firearm from said catch lever and is fixedly interconnected with said catch lever by a pivot pin for rotation as a unit.

11. The alarm system of claim 2 in which said catch lever includes a first section operated by the magazine follower to lock the breech block in the open position and a second, separate section operated by the magazine follower to operate said first switching circuit.

12. The alarm system of claim 2 in which said first switching circuit includes a switching device.

13. The alarm system of claim 12 in which said switching device includes at least one switch.

14. The alarm system of claim 12 in which said switching devices are mounted on the firearm.

15. The alarm system of claim 1 in which said indicator device provides a representation of an empty condition and of a malfunction.

16. The alarm system of claim 1 in which the representation provided by said indicator device includes a visual display.

17. The alarm system of claim 16 in which said visual display includes at least one light.

18. The alarm system of claim 16 in which said visual display includes an alphanumeric readout.

19. The alarm system of claim 2 in which the firearm includes two handle grips and at least one of said grips includes a housing for holding at least a portion of said first switching circuit.

20. The alarm system of claim 19 in which said first switching circuit includes a power source and said power source is in said housing.

21. The alarm system of claim 20 in which said power source includes a battery.

22. The alarm system of claim 1 in which said indicator device is mounted on the firearm.

23. The alarm system of claim 1 in which the firearm includes handle grips and said indicator device is fixed to one of said grips.

24. The alarm system of claim 2 in which said first switching circuit is always energized and operates automatically.

25. The alarm system of claim 2 in which said first switching circuit includes a test switch for energizing said indicator device to demonstrate its operability.

26. The alarm system of claim 17 in which said switching system includes an adjustment device for setting the brightness of said at least one light.

27. The alarm system of claim 26 in which said adjustment device senses ambient light levels and sets the brightness of said at least one light as a function of the ambient light.

28. The alarm system of claim 17 in which said at least one light includes an LED.

29. The alarm system of claim 13 in which said at least one switch includes a membrane switch.

30. The alarm system of claim 29 in which the firearm has handle grips and said membrane switch is mounted in an internal recess in one of said grips.

31. The alarm system of claim 2 in which said firearm includes handle grips, said switching system includes a power source in one of said grips and said first switching circuit in the other of said grips and said power source and said first switching circuit are electronically interconnected by a first flat ribbon conductor disposed within the existing grips.

32. The alarm system of claim 31 in which said power source is housed within a second flat ribbon conductor interconnected with said first flat ribbon conductor.

33. The alarm system of claim 23 in which said indicator device is contained in a mounting box and said one of said grips includes a recess for receiving said mounting box.

34. The alarm system of claim 33 in which said mounting box is sized for an interference fit with said recess.

35. The alarm system of claim 21 in which said battery is mounted internally on one said handle grip and extends into an aperture existing on the firearm frame.

36. The alarm system of claim 2 in which said firearm includes handle grips, said switching system includes a power source in one of said grips and said first switching circuit in the other of said grips and said power source and first switching circuit are electrically interconnected by conductors in each of said grips and connection pins in one grip that engage sockets in the other grip.

37. The alarm system of claim 1 further including a remote data connector responsive to said switching system for providing a representation of the condition of the firearm to a remote device.

38. The alarm system of claim 1 in which the firearm is a pistol.

39. The alarm system of claim 1 in which the firearm is a rifle.

40. The alarm system of claim 1 in which the firearm is a shotgun.

41. The alarm system of claim 3 in which said monitoring device includes a switching device.

42. The alarm system of claim 41 in which said switching device includes at least one switch.

43. The alarm system of claim 41 in which said switching device includes a plurality of switches.

44. The alarm system of claim 41 in which said switching device is mounted on the firearm.

45. The alarm system of claim 1 in which said indicator device provides a representation of the number of cartridges remaining in said magazine.

46. The alarm system of claim 1 in which said indicator device provides a representation of the total number of cartridges remaining in said magazine and chamber of the firearm.

47. The alarm system of claim 1 in which said indicator device provides a representation that the last cartridge is in the chamber and the magazine is empty.

48. The alarm system of claim 1 in which the magazine follower includes a follower element and a spring device for urging said follower element to feed the cartridges to said firearm.

49. The alarm system of claim 48 in which the magazine follower includes a follower element, an intermediate element spaced from said follower element, a first spring device between said elements and a second spring device engaged with the side of said intermediate element opposite said first spring device.

50. The alarm system of claim 49 in which said first spring device opens before said second spring device and remains open while said second spring device opens.

51. The alarm system of claim 49 in which the magazine follower includes a limiter device interconnecting said elements to define the distance by which said elements can be separated by said first spring device.

52. The alarm system of claim 49 in which the magazine follower mechanism includes an actuator mounted for movement with said intermediate element.

53. The alarm system of claim 48 in which the magazine follower mechanism includes an actuator mounted for movement with said follower element.

54. The alarm system of claim 49 in which said second spring device includes two spring sections, an upper and a lower section, said upper section being smaller in diameter than said lower section.

55. The alarm system of claim 3 in which the firearm includes two handle grips and at least one of said grips includes a housing for holding at least a portion of said monitoring device.

56. The alarm system of claim 55 in which said monitoring device includes a power source and said power source is in said housing.

57. The alarm system of claim 56 in which said power source includes a battery.

58. The alarm system of claim 3 in which said representation provided by said indicator device includes a visual display, said visual display includes at least a first light, and said first light is energized when there is but one cartridge remaining in the chamber of the firearm.

59. The alarm system of claim 16 in which said visual display includes two lights, the first of which is energized when there is one cartridge left in the chamber of the firearm and the second of which is energized where there is one cartridge in the chamber and one cartridge left in the magazine.

60. The alarm system of claim 59 in which said first light is red and said second light is yellow.

61. The alarm system of claim 16 in which said visual display includes three lights, the first of which is energized when there is one cartridge left in the chamber of the firearm, the second of which is energized where there is one cartridge in the chamber and one cartridge left in the magazine, and the third of which is energized when there is one cartridge in the chamber and two cartridges left in the magazine.

62. The alarm system of claim 61 in which said first light is red, said second light is yellow, and said third light is green.

63. The alarm system of claims 58, 59, or 61 in which said first light remains energized after the last cartridge has been fired.

64. The alarm system of claim 16 in which said visual display includes at least two lights, one of which is energized when there is one cartridge left in the chamber and none in the magazine, said one of which lights and at least one other of said lights is energized when the magazine and chamber are empty and the breech block is locked open.

65. The alarm system of claim 16 in which said visual display includes three lights, with six different combinations, the first light is energized when there is one cartridge left in the chamber of the firearm, the second light is energized when there is one cartridge in the chamber and one cartridge in the magazine, the third light is energized when there is one cartridge in the chamber and two cartridges in the magazine, the first, second and third lights are energized when the magazine is empty, the chamber is empty of cartridges, and the breech bolt is locked open by the catch lever; the first light is deenergized when the empty magazine is ejected leaving the second and the third lights energized with a breech bolt locked open by the catch lever, and the first, second, and third lights are not energized when the magazine is full the breech bolt is free from the catch lever and the magazine is not in the firearm and the breech bolt is free from the catch lever.

66. The alarm system of claim 3 in which said monitoring device is always enabled and operates automatically upon the level of cartridges reaching a predetermined level.

67. The alarm system of claim 3 in which said monitoring device includes a test switch for energizing said indicator device to demonstrate its operability.

68. The alarm system of claim 17 further including an adjustment device for setting the brightness of said at least one light.

69. The alarm system of claim 68 in which said adjustment device senses ambient light levels and sets the brightness of said at least one light as a function of the ambient light.

70. The alarm system of claim 17 in which said at least one light includes an LED.

71. The alarm system of claim 3 in which said second switching circuit includes at least one switch element and one operator element and an actuator for operating said switch element.

72. The alarm system of claim 71 in which said switch element includes a membrane switch.

73. The alarm system of claim 71 in which said switching device includes a membrane switch and the firearm includes an aperture for permitting said actuator to engage said membrane switch.

74. The alarm system of claim 72 in which the firearm has handle grips and said membrane switch is mounted in an internal recess in one of said grips.

75. The alarm system of claim 74 in which said operator element is mounted on the inside of a said grip and extends through an aperture in the handle of the firearm.

76. The alarm system of claim 3 in which said firearm includes handle grips, said monitoring device includes a power source in one of said grips and said second switching circuit in the other of said grips and said power source and said second switching circuit are electronically interconnected by a first flat ribbon conductor disposed within the existing grips.

77. The alarm system of claim 76 in which said power source is housed within a second flat ribbon conductor interconnected with said first flat ribbon conductor.

78. The alarm system of claim 3 in which said second switching circuit includes at least one switch element responsive to said actuator.

79. The alarm system of claim 78 in which said switch element includes a membrane switch.

80. The alarm system of claim 53 in which said actuator is spring loaded and the firearm includes handle grips and one of said handle grips includes a recess for accommodating extension of said actuator protruding from said magazine for permitting the magazine to move freely in the firearm and a camming surface at the end of the recess for gradually compressing said actuator to facilitate removal of the magazine from the firearm.

81. The alarm system of claim 53 in which said actuator has two actuator elements, one extending from each side of said magazine.

82. The alarm system of claim 81 further including a monitoring device and a switching device which includes at least one switch element associated with each side of said magazine for operation by an associated one of said actuator elements.

83. The alarm system of claim 81 in which said actuator elements are spring loaded and the firearm includes two handle grips, each of said handle grips includes a recess for accommodating extension of the associated said actuator element protruding from said magazine for permitting the magazine to move freely, centrally, longitudinally in the firearm and a camming surface at the end of each recess for gradually compressing said actuator elements to facilitate removal of said magazine from the firearm.

84. The alarm system of claim 3 in which said second switching circuit includes at least one switch element, each switch element includes a pair of spaced conductors and said actuator includes a conductive contact for bridging said spaced conductors and electrically connecting them to actuate said indicator device.

85. The alarm system of claim 57 in which said battery is mounted internally on a said handle grip and extends into an aperture existing on the firearm frame.

86. The alarm system of claim 3 in which said firearm includes handle grips, said monitoring device includes a power source in one of said grips and said switching device in the other of said grips and said power source and a switching device are electrically interconnected by conductors in each of said grips and connection pins in one grip that engage sockets in the other grip.

87. The alarm system of claim 53 in which said actuator includes a spring loaded actuator element and said actuator element includes a cam surface to guide it back into said magazine to facilitate easy loading of said magazine.

88. The alarm system of claim 3 in which the magazine follower includes a follower element and an intermediate element spaced from said follower element, a first spring device between said elements and a second spring device engaged with the side of said follower element facing said intermediate element.

89. The alarm system of claim 41 in which the firearm includes a magazine release mechanism, said switching device is biased to enter an aperture in said magazine to engage said actuator, and said switching device includes an interconnection device responsive to said release mechanism for overcoming the bias and retracting said switching device from said magazine aperture simultaneously with the operation of said release to enable said magazine to freely fall from the firearm.

90. The alarm system of claim 41 in which the magazine and switching device are in the frame of the firearm.

91. The alarm system of claim 41 in which the magazine is mounted in a magazine receiver and the switching device is mounted on the outside of the receiver through an aperture.

92. The alarm system of claim 53 in which the magazine follower mechanism includes two interconnected sections movable relative to each other, said actuator includes at least one actuator element on at least one of said sections and biasing means for urging apart said sections and urging said actuator element to engage said switching device.

93. The alarm system of claim 52 in which said actuator has an actuator element extending from each side of said magazine.

* * * * *